US005602356A

United States Patent [19]

Mohrbacher

[11] Patent Number: 5,602,356

[45] Date of Patent: Feb. 11, 1997

[54] ELECTRONIC MUSICAL INSTRUMENT WITH SAMPLING AND COMPARISON OF PERFORMANCE DATA

[75] Inventor: Bernard Mohrbacher, Santa Barbara, Calif.

[73] Assignee: Franklin N. Eventoff, Ferndale, Wash.

[21] Appl. No.: 223,197

[22] Filed: Apr. 5, 1994

[51] Int. Cl.[6] ..... A63H 5/00; G04B 13/00; G10H 7/00

[52] U.S. Cl. ..... 84/609; 84/603

[58] Field of Search ..... 84/600–603, 609

[56] References Cited

U.S. PATENT DOCUMENTS

| | | | |
|---|---|---|---|
| Re. 32,862 | 2/1989 | Wachi . | |
| 197,648 | 11/1877 | McChesney et al. . | |
| 2,253,782 | 8/1941 | Hammond et al. | 84/423 |
| 2,557,690 | 6/1951 | Reuther | 84/423 |
| 2,611,291 | 9/1952 | Heim | 84/427 |
| 4,442,486 | 4/1984 | Mayer | 364/200 |
| 4,454,594 | 6/1984 | Heffron et al. | 364/900 |
| 4,462,076 | 7/1984 | Smith, III | 364/200 |
| 4,644,840 | 2/1987 | Franz et al. | 84/1.01 |
| 4,658,695 | 4/1987 | Cutler | 84/424 |
| 4,686,880 | 8/1987 | Salani et al. | 84/1.01 |
| 4,748,887 | 6/1988 | Marshall | 84/1.15 |
| 4,771,671 | 9/1988 | Hoff, Jr. | 84/1.01 |
| 4,777,857 | 10/1988 | Stewart | 84/1.01 |
| 4,794,838 | 1/1989 | Corrigau, III | 84/1.01 |
| 5,005,461 | 4/1991 | Murata | 84/646 |
| 5,062,097 | 10/1991 | Kumaoka | 369/70 |
| 5,074,182 | 12/1991 | Capps et al. | 84/609 |
| 5,092,216 | 3/1992 | Wadhams | 84/602 |
| 5,099,738 | 3/1992 | Hotz | 84/617 |
| 5,111,727 | 5/1992 | Rossum | 84/603 |
| 5,140,887 | 8/1992 | Chapman | 84/646 |
| 5,208,421 | 5/1993 | Lisle et al. | 84/645 |
| 5,262,583 | 11/1993 | Shimada | 84/609 |
| 5,262,584 | 11/1993 | Shimada | 84/609 |
| 5,278,346 | 1/1994 | Yamaguchi . | |
| 5,453,569 | 9/1995 | Saito et al. | 84/609 |
| 5,466,882 | 11/1995 | Lee | 84/603 |

FOREIGN PATENT DOCUMENTS

| | | | |
|---|---|---|---|
| 0248438 | 8/1988 | Japan . | |
| WO87/00330 | 1/1987 | WIPO | 1/34 |
| WO91/11691 | 8/1991 | WIPO . | |

OTHER PUBLICATIONS

Suzuki Corporation, "Omnichord System 100, System 200m Operation Manual", 1990.

Halaby et al, "The MIDIKeys Window", Visions, Professional Sequencing Software, 1989, Chapter 20, p. 331, published by OPCode Systems, Menlo Park, CA.

Hotz Instrument Technology Systems, Product Summary, 1988, Hotz Instrument Technology, 11835 W. Olympic Blvd., W. Los Angeles, CA 90064.

Starr Switch Company, "ZTAR, MIDI Fingerboard Controllers" Starr Instruments brochure, 1993.

"Atari Unveils First Musical Instrument", The Music and Sound Retailer, Feb.–Mar. 1988, pp. 1 & 22.

Mard Naman, "Jimmy Hotz's MIDI Magic", Start the ST Monthly, Apr. 1989, pp. 21–26.

Serge Modular Musical Systems, San Francisco, "The Magic Band" and Playing Band From Power–On to Power Off, 1983.

*Primary Examiner*—William M. Shoop, Jr.
*Assistant Examiner*—Jeffrey W. Donels

[57] ABSTRACT

A music system including a musical instrument, such as a keyboard strummer, in which the musical notes produced by the playing of the instrument are controlled by musical assistance data mapped unto the instrument keys and strum vanes from tracks specially prepared and synchronized with a prior performance of the piece. Modified mass media, such as CD ROM, TV signals and video cassettes are provided including synchronized note assist data and additional media, such as ROM packs or tone encoded audio cassettes or CDs, are provided with synchronizable note assist data for use with unmodified mass media.

11 Claims, 15 Drawing Sheets

ELECTRONIC MUSICAL INSTRUMENT WITH SAMPLING AND COMPARISON OF PERFORMANCE DATA

BACKGROUND OF THE INVENTION

1. Field of the Invention

This invention relates to techniques for producing music, and, in particular, to polyphonic electronic musical instruments and related systems.

2. Description of the Prior Art

Musical instrument designs range from conventional instruments played by hand, such as a violin or electric guitar, to pre-programmed instruments, such as player pianos, to programmable instruments such as keyboard synthesizers. The level of skill required to produce music with non-programmed hand instruments may be very high and requires a substantial investment of time and effort, while the quality of the music produced by pre-programmed or programmable instruments often lacks some of the human individuality that makes music so pleasurable.

What are needed are techniques for producing music which retain more of the human individuality of non-programmed instruments while reducing the level of skill and investment needed to produce, or re-produce, music which retains a high level of the human individuality qualities of music produced with more conventional instruments.

SUMMARY OF THE INVENTION

In accordance with the present invention, methods and systems are provided for producing music retaining a substantial level of the individuality achievable with non-programmed instruments while reducing the level of skill and investment required to produce such high quality music by partially programming the instrument in accordance with a pre-recorded performance. In particular, a performance by a popular musician may be recorded, for example, as a music video and encoded with musical note assistance data synchronized with the music video so that a musician or student with comparatively less skill and experience may produce a relatively high quality individualistic rendition of the original performance on a specially designed musical instrument partially programmed by the encoded musical note assistance data.

In overview, the present invention therefore provides musical note assistance data serially encoded by a studio musician in response to a recording of a live performance. The encoded data is provided to a specially configured musical instrument which is programmed by the encoded data synchronously with the presentation of the performance to a student musician who plays along with the performance by stroking or striking, and strumming, keys and vanes of the instrument. That is, the musical note assistance data is used to map predetermined values to the keys and other input devices of the instrument being played synchronously with the presentation of the pre-recorded performance. The striking and strumming is decoded by a microprocessor which produces note generating information to an audio output device in which some of the musical qualities such as scale and chord are determined by the musical assistance data provided by the studio musician while other musical qualities such as the particular note within the scale or chord, as well as other note qualities such as loudness, degree of bending, and after-touch, are determined by the manner in which the student musician plays the instrument. In a preferred embodiment, the instrument includes a keyboard section, a strummer section and a set of programming function keys for further controlling the operation of the microprocessor which creates the music in response to the playing of the instrument and the synchronized musical note assistance data.

The instrument is played by striking and strumming mechanical input devices which respond to the musician's touch thereby providing mechanical feedback or "feel" to the musician playing the instrument.

In a first aspect, the present invention provides method and apparatus for producing music from a plurality of input keys, or other means, each responsive to activation by a musician for producing individual music related output signals, time varying music note assistance data synchronized with portions of a musical piece, and means for mapping portions of the music note assistance data to each of the plurality of input means to affect musical qualities of the music related output signals produced by activation of each of the plurality of input keys in a time varying manner synchronized with said musical piece.

In another aspect, the present invention provides an electronic instrument for producing music related to pre-recorded music in response to playing by a musician having memory means for storing note assist data for the pre-recorded music and for storing a set of master samples of the pre-recorded music, session means for deriving session samples from a session performance of the pre-recorded music, curve fitting means for comparing each of a plurality of subsets of the session samples to the set of master samples to synchronize the note assist data with the session performance, and means responsive to playing by the musician to produce music related to the session performance by the note assist data.

In still another aspect, the present invention provides a method for assisting a musician to produce music related to pre-recorded music by providing a session performance of the pre-recorded music to the musician, comparing each of a plurality of subsets of samples of the session performance to a pre-recorded set of samples of the pre-recorded music to determine a correlation therebetween, providing note assist data related to the pre-recorded music, the providing being synchronized with the session performance in response to the comparing, and producing music in response to actions of the musician in accordance with the note assist data being provided at the time of the actions.

In accordance with another aspect, the present invention provides a method for assisting a musician to produce a musical rendition related to pre-recorded music by recording one or more tracks of note assist data synchronized to a studio performance of the pre-recorded music, each track of note assist data representing a musical component of the original music, deriving a master sampling interval of samples of a beginning portion of the pre-recorded music, deriving performance samples of a beginning portion of a session performance of the pre-recorded music, forming a series of sequential performance sampling intervals from subsets of the performance samples, comparing each performance sampling interval to the master sampling interval to determine the correlation therebetween, synchronizing the note assist data with the session performance in accordance with the correlation, producing key signals in response to musical instrument actuation by the musician during the session performance of the pre-recorded music, and producing a rendition related to the pre-recorded music in response to the key signals modified by the note assist data provided at the time of the actuation that produced each such key signal.

These and other features and advantages of this invention will become further apparent from the detailed description that follows which is accompanied by drawing figures. In the figures and description, reference numerals indicate various features of the invention, like numerals referring to like features throughout both the drawing figures and the description.

DETAILED DESCRIPTION

Figure 1:
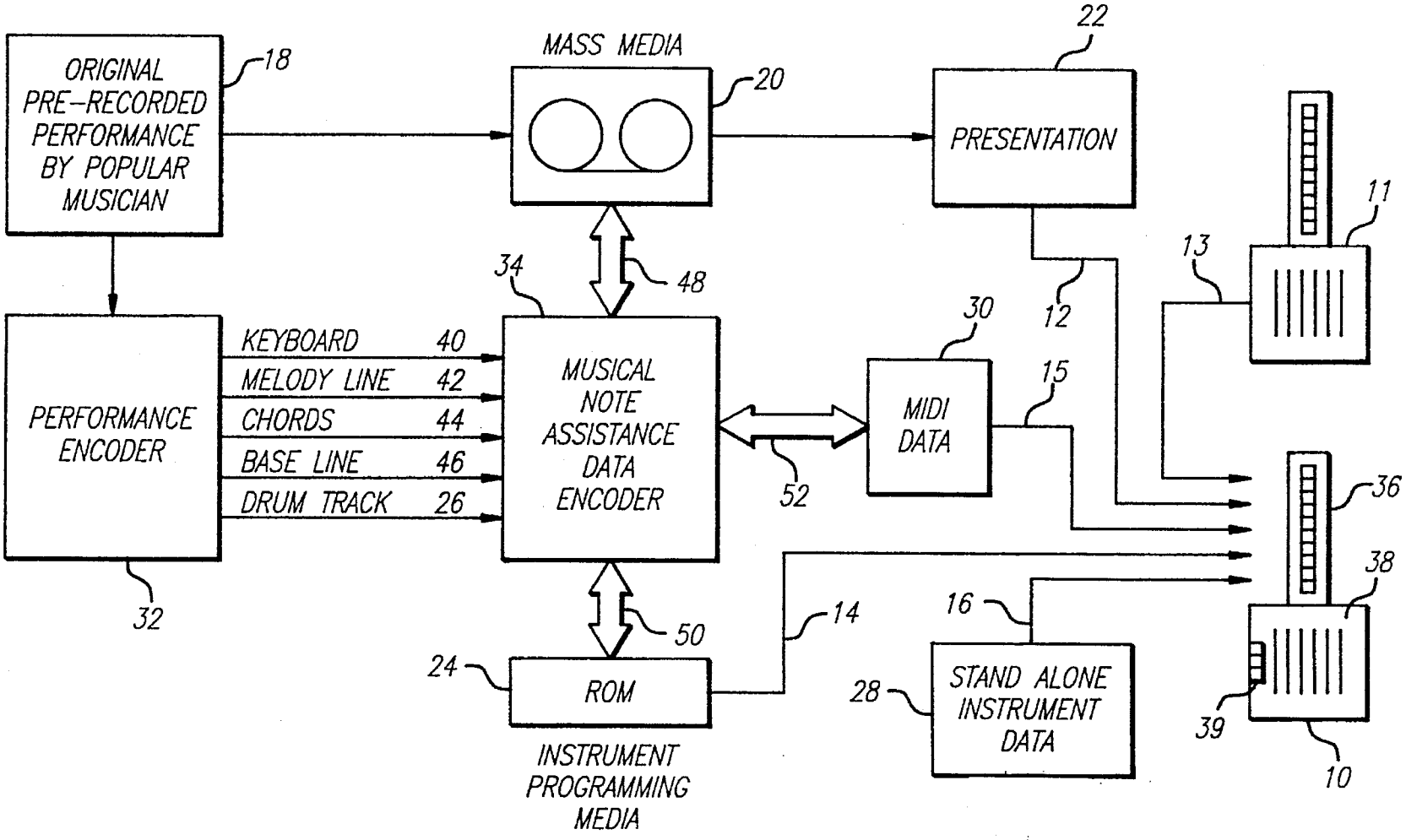
FIG. 1 is a block diagram overview of the operation of the present invention in which musical note assistance data is encoded from a pre-recorded performance and decoded for later use in configuring the response of a compatible musical instrument, such as the keyboard/strummer shown.

Referring first to FIG. 1, a block diagram overview of the present invention is shown in which a special purpose musical instrument, such as keyboard/strummer 10, is partially preprogrammed for playing in a mass media mode by mass media input 12, or in a specialized media mode by specialized media input 14, MIDI data input 15 or network input 13, or in a stand alone performance mode by stand alone programming input 16. In these modes specially encoded, musical note assistance data from pre-recorded performance 18 is provided to keyboard/strummer 10 by inputs 12, 13, 14, 15, or 16.

With regard first to the mass media mode, musical note assistance data encoded on mass media 20 is provided to keyboard/strummer 10 by means of mass media input 12. Pre-recorded performance 18 is reproduced in a conventional manner on mass media 20, which may be an audio or video cassette, a CD ROM or other conveniently distributable media. Alternatively, mass media 20 may be the transmission by broadcast media of a music data performance, such as a TV broadcast of a conventional or special purpose music television program. Mass media 20 is played—or displayed—on a suitable presentation device, such as mass media player 22, which may be a TV receiver or a VCR player or an audio cassette player system or similar device, depending on the type of media represented by mass media 20.

When pre-recorded performance 18 is presented on mass media player 22, musically encoded data added to mass media 20 is provided by means of mass media input 12 to keyboard/strummer 10 to partially pre-program keyboard/strummer 10 so that the instrument may be played simultaneously with the reproduced performance. As will be described below in greater detail, mass media input 12 causes the response of keyboard/strummer 10 to be musically consistent with pre-recorded performance 18 being watched and/or heard by the person playing the instrument. For a simple example, the keyboard keys or other input devices of keyboard/strummer 10 may be programmed by mass media input 12 so that when the reproduced performance included notes played in a particular scale, the keyboards keys were preprogrammed to respond in that scale when played. Thereafter, during the same performance, when notes in the reproduced performance were played in a different scale, the keyboard keys would be preprogrammed to respond in that different scale when played.

With regard to the other musical note assistance data inputs, such as network input 13, specialized media input 14, MIDI data input 15, and stand alone programming input 16, the musical note assistance data is provided to keyboard/strummer 10 so that the instrument may be played in a performance separate from a reproduction of pre-recorded performance 18. That is, when musical note assistance data is provided to keyboard/strummer 10 by means of mass media input 12, the instrument is played by a person while that person is watching and/or hearing the reproduction of pre-recorded performance 18. However, when musical note assistance data is provided to keyboard/strummer 10 by another input, such as specialized media input 14, the instrument will probably be played without watching and/or hearing a reproduction of pre-recorded performance 18 although there is nothing in the present invention to prevent watching and/or hearing pre-recorded performance 18 at that time if desired.

In order to synchronize playing of keyboard/strummer 10 without watching and/or hearing pre-recorded performance 18, it is convenient to provide a metronomic beat such as live drum track 26, as will be described below with regard to ROM pack 24 and specialized media input 14.

With regard now to network input 13, musical note assistance data provided by any input to an instrument, such as keyboard/strummer 10, may be re-applied therefrom to another similar instrument by means of a simple network connection. For example, musical note assistance data applied, by means not shown, to keyboard/strummer 11 may be re-applied by network input 13 directly to keyboard/strummer 10 so that both instruments are programmed synchronously from the same musical note assistance data.

With regard now to specialized media input 14, which may conveniently provide musical note assistance data to keyboard/strummer 10 in the form of data from a specialized instrument programming media such as ROM pack 24, the same encoded musical note assistance data is provided to keyboard/strummer 10 as is provided by mass media input 12, with or without the simultaneous reproduction of pre-recorded performance 18. That is, when keyboard/strummer 10 is controlled by means of mass media input 12, the person playing keyboard/strummer 10 watches and/or hears the performance of pre-recorded performance 18 by means of mass media player 22. When keyboard/strummer 10 is controlled by means of specialized media input 14, the person playing keyboard/strummer 10 does not necessarily watch and/or hear the performance of pre-recorded performance 18 and therefore may require some other mechanism for synchronization with the pre-recorded performance.

For this and other reasons, it may be convenient to provide an audible metronome in the form, for example, of live drum track 26 which is added to ROM pack 24 during the musical data encoding operation described in greater detail herein below. In addition to, or as an alternate to, listening to such a drum track metronome during the playing session, the playing musician may select to listen to some or all portions of pre-recorded performance 18, such as the melody, bass or chord tracks, which are included in the mapping data and may therefore be played for the playing musician by the system during the playing session.

With regard now to MIDI data input 15, musical note assistance data may be provided to keyboard/strummer 10 in a standard format, such as the MIDI format presently used with most musical keyboard synthesizers. Musical equipment using standard format musical data, such as MIDI equipment 30, may provide musical note assistance data in MIDI format while also providing other data, for the same or similar purposes. For example, MIDI equipment 30 may be a Karioke machine used to display textual data for singing along with pre-recorded performance 18 while providing musical note assistance data in MIDI format so that keyboard/strummer 10 may also be played along with a reproduction of pre-recorded performance 18.

With regard now to the stand alone programming mode, keyboard/strummer 10 may be played without external input, but still obtain musical note assistance for playing in the stand alone mode by means of stand alone instrument data 28 provided by stand alone programming input 16. In the stand alone mode, as is true for many conventional non-electronic instruments, activation of certain sets of instrument keys programs the response of other keys to such activation. That is, keyboard/strummer 10 is partially programmed by the player during the performance in the same general way that an autoharpist or guitar player programs the response of the strummed strings by the manner and timing with which the fret is fingered.

In the preferred embodiment shown in FIG. 1, musical note assistance data is derived from pre-recorded performance 18 by a studio musician during a performance encoding session using performance encoder 32. Performance encoder 32 may operate in a preprogrammed manner by applying predetermined algorithms to pre-recorded performance 18, but it is presently believed that the best quality final programming of keyboard/strummer 10 is accomplished by performance encoding by a live musician.

To encode pre-recorded performance 18 by means of performance encoder 32, the studio musician listens to and/or watches pre-recorded performance 18 to record additional tracks of music then encoded by musical note assistance data encoder 34 as described in greater detail below with regard to FIG. 2. Although the particular additional tracks to be recorded by means of performance encoder 32 may depend upon the type of instrument to which the musical note assistance data will be applied, the following generalized description of the tracks to be recorded for the embodiment shown in FIG. 1 will provide sufficient information so that variations of the tracks may easily be derived for specific applications.

During performance encoding, four or five tracks of musical data are produced by performance encoder 32 for use in creating musical note assistance data in musical note assistance data encoder 34 to be recorded as musical note assistance data 48 with pre-recorded performance 18 on mass media 20 or separately as musical note assistance data 50 in ROM pack 24 or as MIDI format musical note assistance data 52 in MIDI equipment 30. Four of these tracks are shown in FIG. 1 as keyboard track 40, melody line 42, chords 44 and base line 46. As noted above, when the musical note assistance data is used in keyboard/strummer 10 without an observable, simultaneous reproduction of pre-recorded performance 18, such as when keyboard/strummer 10 is provided with specialized media input 14 from ROM pack 24 or MIDI data input 15 from MIDI equipment 30, it is advantageous to provide a metronomic beat and/or one or more tracks of performance data during the playing session for synchronizing the playing of keyboard/strummer 10.

The four or five tracks to be produced by performance encoder 32 may conveniently be produced serially. That is, the studio musician, after becoming sufficiently familiar with pre-recorded performance 18, first records one track such as keyboard track 40 while listening to pre-recorded performance 18. Thereafter, the studio musician then replays pre-recorded performance 18 each time an additional track is recorded.

In the embodiment shown, the musical note assistance data is applied to keyboard/strummer 10 which includes keyboard section 36, strummer 38 and function programming keys 39. Keyboard section 36 is a multi-octave keyboard, strummer 38 represents the equivalent of a six stringed instrument for strumming, such as the strummable section of a guitar, while function programming keys 39 are used to further control the programming and operation of instrument microprocessor 108 shown in FIG. 3. Function programming keys 39 may include conventional keyboard keys for data entry for user programming input as well as proportional input keys, such as rocker keys, in which activation of one part of the key indicates an increase of value while activation of another part of the key indicates a desired decrease in value. For example, a rocker key, not shown, could be dedicated for use primarily for volume control so that pressure on the upper part of the key increased volume while pressure on the lower part of the key would decrease volume. Similar keys, such as additional rocker keys, could be used for varying musical effects during the performance such as tremolo.

Conventional musical instruments, such as keyboard synthesizers, may be modified for use in place of keyboard/strummer 10. The details and operations of such instruments may be understood from the detailed description of portions of the keyboard and strummer input assemblies of keyboard/strummer 10 shown in FIGS. 4 and 5.

With regard now to the use of keyboard track 40 to pre-program the operation of keyboard/strummer 10 as shown in FIG. 1, the musical note assistance data provided by this track is used to select the scale of the keys of keyboard section 36. For example, if pre-recorded performance 18 begins with a bar of music in the C major scale, keyboard track 40 programs keyboard section 36 to represent appropriate octaves of keys in the C major scale. When a musical note is encountered in pre-recorded performance 18 in another scale (as what may be called an accidental or occasional note) keyboard track 40 programs keyboard section 36 in that new scale. After the accidental note, if the music returns to the C major scale, keyboard track 40 is then used to return the programming of keyboard section 36 to the C major scale.

In particular, to program keyboard section 36 for a particular scale such as the C major scale, the studio musician would cause keyboard track 40 to include the first seven notes of that scale. The first encoded note is the root note of the scale to be played. The eighth note or octave note is by definition, in Western music, always a repetition of the first note in that scale. The multi-octave keys of keyboard section 361 may therefore be programmed to a particular scale by the playing of seven notes in order in that scale on keyboard track 40 at, or just before, the scale change in pre-recorded performance 18. Thereafter, keyboard track 40 is encoded in musical note assistance data encoder 34 to produce musical note assistance data 48 to be added to pre-recorded performance 18 on mass media 20, or to produce musical note assistance data 50 to be applied to ROM pack 24 or to produce musical note assistance data 52 to be applied to MIDI equipment 30.

With regard now to melody line 42 and base line 46, a single note for each line is programmed to represent that track. Each such note may change relatively infrequently during pre-recorded performance 18 so it is only necessary for the studio musician to play the appropriate note during the recording of the tracks for melody line 42 and base line 46 whenever the note changes.

Chord track 44 requires more notes than melody or baseline tracks 42 or 46. In the particular embodiment shown in FIG. 1, keyboard/strummer 10 includes strummer 38 which conveniently includes six playable vanes, one of which is described below in greater detail with regard to FIG. 4. In order to program the six note chord represented by six vane strummer 38, six notes must be played to program chord track 44 whenever the chord in pre-recorded performance 18 changes.

As noted above, live drum track 26 may be programmed only when the note assist data is provided to keyboard/strummer 10 without the simultaneous presentation of pre-recorded performance 18. Live drum track 26 would therefore likely be recorded during the programming of musical note assistance data 50 for ROM pack 24 or MIDI format musical note assistance data 52 for MIDI equipment 30.

In addition to programming the note assistance data, additional data and information may be encoded on playable mass media 20 and/or ROM pack 24 such as automatic queuing data. If, for example, playable mass media 20 is a standard compact disk or CD ROM with a selection of different musical tracks such as songs 1 through 20, the appropriate note assistance data may be encoded on ROM pack 24 as musical note assistance data 50 rather than directly on the CD ROM. In addition, data including information sufficient to identify a specific point early in the recorded performance, such as the first few milliseconds of sound at the beginning of each song, would also be recorded on ROM pack 24 within musical note assistance data 50 for later use for synchronization during the playing session as described below, for example, with regard to queuing comparator 121 in FIG. 3.

Figure 2:
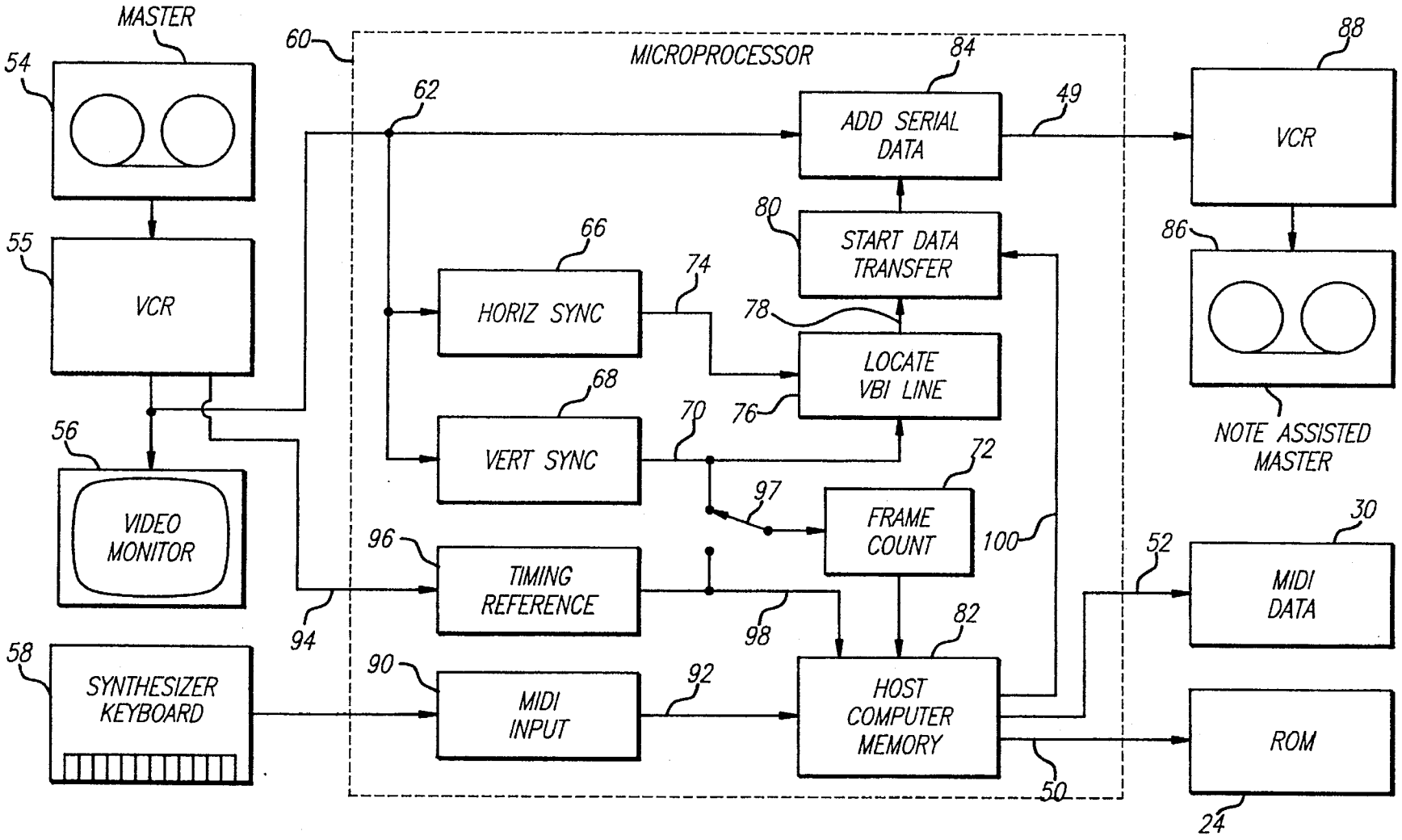
FIG. 2 is a block diagram of the musical note assistance data encoding portion of the present invention shown in FIG. 1.

Referring now to FIG. 2, the encoding of music assistance data will be described in greater detail. An appropriate copy of pre-recorded performance 18 is provided on conventional master 54 which, for the purposes of the following description, is assumed to be a video cassette master of a particular music video performance. Pre-recorded performance 18 is played on VCR 55 for presentation on music video display 56 by means of video input 62. A studio musician, not shown, watches and/or hears the performance of pre-recorded performance 18 on music video display 56 and operates studio synthesizer keyboard 58 to produce the desired tracks. It is expected that under most conditions, the studio musician will become familiar with pre-recorded performance 18 by watching and/or hearing one or more presentations thereof and then, while watching and/or hearing additional performances thereof, play the appropriate notes on studio synthesizer keyboard 58 to produce each individual track.

A music sequencing device such as studio synthesizer keyboard 58 is conveniently connected to specially configured microprocessor 60 which incorporates performance encoder 32 and musical note assistance data encoder 34 described above with respect to FIG. 1. Specially configured microprocessor 60 may conveniently be a conventional desk-top microcomputer including one or more additional plug-in cards to provide the functions described herein. In such a configuration, host computer memory 82 would likely be a part of the conventional portion of the desk-top computer while the remaining functions shown within microprocessor 60 in FIG. 2 would be included on one or more special purpose plug-in cards.

Video input 62 from VCR 55 is applied as the video input to microprocessor 60 as well as to music video display 56. Within microprocessor 60, video input 62 is applied to horizontal sync detector 66 which operates on the video signal to detect and synchronize with every horizontal scan line in the video signal. Video input 62 is also applied to vertical sync detector 68 which operates on the video signal to detect and synchronize with every vertical sync signal.

Each such vertical sync signal represents the beginning of a vertical blanking interval conventionally used to return the cathode ray raster scan to the top of the screen to begin the next frame of the video signal. Vert sync signal 70 at the output of vertical sync detector 68 is therefore applied to video frame counter 72 which is used to maintain an accurate count of the horizontal scan line in the video signal. The vertical sync signal may conveniently be detected by measuring the pulse width of the video signals because the vertical sync signal is provided by half-width pulses.

After the pulse width returns to normal, the vertical blanking interval or VBI begins. Within the VBI are a fixed number of VBI scan lines, often used to carry information not displayed in the video image, such as color or contrast or calibration information. In accordance with the present invention, a particular VBI scan line or lines is used to carry the musical note assist data. At the present time, there is no universally accepted standard for the use of particular VBI scan lines for particular data, so the following discussion will assume that the first VBI scan line will be the music data VBI scan line used for musical assist data. In any particular application, a different VBI scan line may be selected for this purpose.

Vert sync signal 70 from vertical sync detector 68 is applied to video frame counter 72, the output of which is applied to host computer memory 82. The output of video frame counter 72 represents the detection of the vertical sync signal so that the next horizontal sync signal detected thereafter represents the first VBI scan line which, as noted above, is selected as the music data VBI scan line for the purposes of this explanation. Other VBI scan lines may be selected in accordance with known techniques in the art.

Horizontal sync detect signal 74 from horizontal sync detector 66 is applied to VBI scan line locator 76 which receives vert sync signal 70 as its other input. The output of VBI scan line locator 76 represents detection of music data VBI scan line 78 which is applied to start data transfer switch 80.

The amount of music assist data to be applied to the video data may well exceed the data capacity of a single, or even a short series of, VBI scan lines used as music data VBI scan line 78. The data applied to the VBI scan lines are produced at a rate in the range of about 500K bits/second. In addition, the data to be applied is stored in parallel form in host computer memory 82, as will be described in greater detail below. Start data transfer switch 80 is used to gate or control the operation of serial data adder 84 which is used to combine musical note assist data from host computer memory 82 with the video input so that the data is transferred serially for addition to the selected VBI scan line only during the interval of time when music data VBI scan line 78 is indicated to be present.

That is, during the detection of the selected horizontal scan line in the detected VBI, host computer memory 82 adds data in a serial fashion to video input 62 to produce musical note assistance data 48 which is applied, together with video input 62, as note assisted video 49 to note assisted master 86 by VCR 88. Playable mass media 20, discussed above with respect to FIG. 1, is made in a conventional manner by copying note assisted master 86.

Studio synthesizer keyboard 58, which may conveniently be part of performance encoder 32 discussed above with respect to FIG. 1, is used to provide MIDI input with keyboard track 40, melody line 42, chords 44, base line 46 and live drum track 26 if used. As noted above, these tracks are often produced in a serial fashion by a studio musician watching and/or hearing multiple renditions of pre-recorded performance 18 and are individually applied by MIDI output 92 to host computer memory 82 for storage. MIDI output 92 is combined with the frame count from video frame counter 72 in order to synchronize each track with pre-recorded performance 18 and therefore with each other.

In order to provide an accurate synchronization of the tracks and performance, conventional approaches may be used such as those employing the SMPTE format in which video frames are counted or a track is added to an audio tape in the form of a longitudinal tone track or LTT. In a preferred embodiment of the present invention, a signal is added to pre-recorded performance 18 on conventional master 54 for use as a master timing signal. One convenient manner in which this may done is to add an audio queue to the beginning of pre-recorded performance 18 by, for example, using the conventional audio dubbing input, not shown, of VCR 55. This audio queue may be applied by VCR audio 94 from VCR 55 to timing reference detector circuit 96 as one way to produce master sync signal 98 which is then applied to host computer memory 82 along with the then current frame count. Alternate techniques for synchronization are described below with regard, for example, to FIG. 11. Depending upon the synchronization technique used, it may be advantageous to apply sync signal 98, instead of vert sync signal 70, to video frame counter 72 as illustrated schematically by selection switch 97.

In this manner, all video and music assistance data, such as tracks 40, 42, 44, 46 and 26 may all easily and accurately be synchronized together. Since these tracks are produced at different times by the studio musician, but must be added together synchronously by serial data adder 84 so that the music assistance data appears during the VBI scan lines in the appropriate video frames, accurate synchronization is important. By using master sync signal 98 at the beginning of the video tape and counting video frames thereafter, the music note assistance data from each track may conveniently and accurately combined with the data from the other tracks to form musical note assistance data 50 applied to ROM pack 24 or MIDI format musical note assistance data 52 applied to MIDI equipment 30.

Alternatively, the use of master sync signal 98 at the beginning of the video tape—and the counting of video frames thereafter—permits the music note assistance data from each track to be combined with the data from the other tracks and synchronized with the video performance to produce note assisted video 49 applied to note assisted master 86 by VCR 88. The format of musical note assistance data 48 may be varied in accordance with the particular application of this invention and/or the particular instrument to be enhanced by the music assistance data such as keyboard/strummer 10 shown in FIG. 1. The application of the music assistance data to the music data VBI scan line may be enhanced by use of a particular format for such data, which would appear on music data line 100 for application by serial data adder 84 to video input 62 under the control of start data transfer switch 80, as described below.

The presently preferred VBI data format includes the following six data items, each with the specified number of bytes: <FLAG-1> <MELODY-1> <BASS-I><CHORD-6> <SCALE-2>) <PROGRAM-4>. A checksum follows each set of six data items for checking the accuracy of data transmission and reception of the data in a conventional manner.

With regard to <FLAG-1>, this is a single byte which signifies the presence or absence of data items, as follows:

| | |
|---|---|
| bit-7 | Always present |
| bit-6 | not presently used |
| bit-5 | not presently used |
| bit-4 | 4 program bytes |
| bit-3 | 2 scale bytes |
| bit 2 | 6 chord bytes |
| bit-1 | 1 bass note |
| bit-0 | 1 melody note. |

With regard to <MELODY-1>, this is a single byte of data indicating the current melody note utilizing the standard MIDI note numbering system. <MELODY-1> is the music assist data representing the melody line track laid down by the studio musician as melody line 42 shown in FIG. 1.

With regard to <BASS-1>, this is a single byte of data indicating the current bass note utilizing the standard MIDI note numbering system. <BASS-1> is the music assist data representing the bass line track laid down by the studio musician as base line 46 shown in FIG. 1.

With regard to <CHORD-6>, this is a set of 6 bytes of data representing the notes applied to each of the six vanes of strummer 38 of keyboard/strummer 10 shown in FIG. 1. <CHORD-6> is the music assist data representing the chord track laid down by the studio musician as chords 44 shown in FIG. 1.

With regard to <SCALE-2>, this is a set of two bytes. The first byte indicates the note assigned to the lowest key on keyboard section 36 of keyboard/strummer 10 as shown in FIG. 1. The second byte utilizes the fact that typical scales in Western musical are composed of a series of notes that have intervals of either one or two half-notes. The scale indication is therefore compressed to a single byte utilizing a zero bit to indicate a half-note and a one bit denoting a whole note interval. That is, the second byte is a series of bits in which the magnitude of the interval between the notes in the desired scale, that is, whether the magnitude of each particular interval is either one or two half-notes, is indicated by the present or absence of a one in the bit location representing that note within the scale. <SCALE-2> is the music assist data representing the keyboard track laid down by the studio musician as keyboard track 40 as shown in FIG. 1.

With regard to <PROGRAM-4>, this set of four bytes of data indicates the instruments sound assignments for the melody, bass, chords and keyboard of the instrument to be programmed, such as keyboard/strummer 10 shown in FIG. 1.

The checksum is a single byte representing a 7 bit checksum of all other bytes in the format including <FLAG-1>.

Synchronization of the data is facilitated by the fact that only <FLAG-1> has bit-7 set so that the beginning of each series of data bytes in the format, that is the format frame, may easily be detected.

The format described above may be implemented on video data by using the two byte, 16 bit data length of a single VBI scan line by putting two bytes of data in each vertical blanking interval. In the worst case situation in which the most data was required, the data items representing <FLAG-1>, <MELODY-1>, <BASS-1>, <CHORD-6>, <SCALE-2>, and the checksum byte would require 1 plus 1 plus 1 plus 6 plus 2 plus 1 byte, respectively, for a total of twelve bytes. At 2 bytes of data per video blanking interval, assuming a bit rate of about 500 Khz, six frames of video data would be required for the encoding of a complete set of such data. Each frame of video data represents 1/60 of a second, so the entire six frames of video data required for the encoding of the maximum required data in the format would only require 1/10 of a second of time. The music changes at a sufficiently slower rate than the video so that a complete change of all tracks of data within 1/10 of a second is sufficient.

The voicing of the instrument, that is, the voice program information provided by <PROGRAM-4> assigning instrument sounds to each of the four functions of the instrument would normally be sent in a configuration of data including only <FLAG-1 >, <PROGRAM-4> and the checksum byte. This would require a total of only six bytes and would therefore only occupy three video frames extending for only 1/20 of a second.

Figure 3:
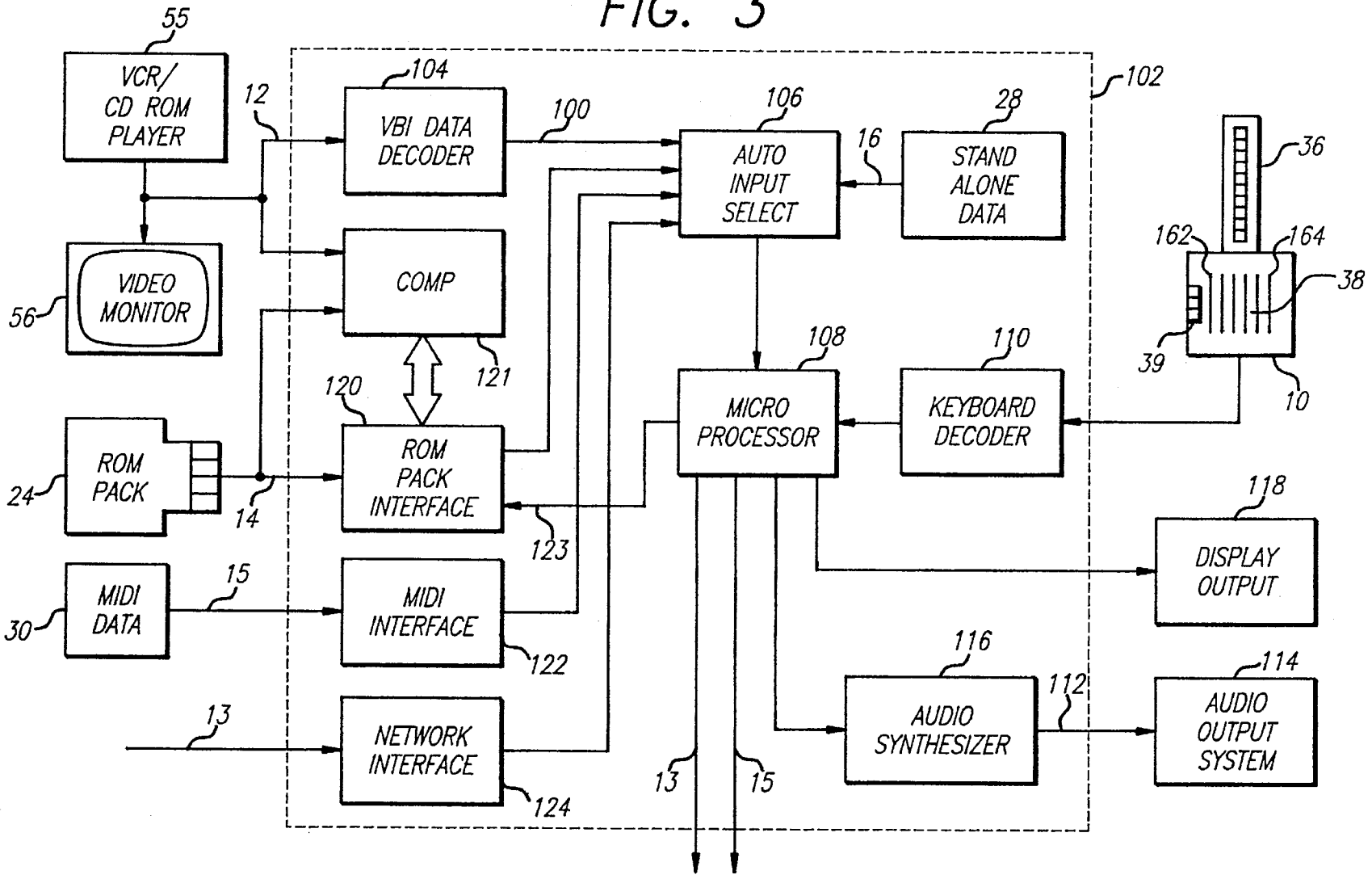
FIG. 3 is a block diagram illustrating the operation of the keyboard/strummer of FIGS. 1 and 2 in response to encoded musical note assistance data.

Referring now to FIG. 3, the following is a description of the operation of keyboard/strummer 10 shown in FIG. 1. As noted above, there are several modes in which keyboard/strummer 10 may be played by the student musician. For convenience of this explanation, the mass media mode in which the input to keyboard/strummer 10 is provided by mass media input 12 will be described first. In this mode, keyboard/strummer 10 is operated under the control of note assisted master 86 produced in accordance with the music note assistance encoding described above with respect to FIG. 2.

In particular, a note assisted video cassette, such as note assisted master 86 or a mass produced and distributed copy thereof, is inserted in an appropriate presentation device such as VCR 55, for display on music video display 56. Although the video and audio presentation of pre-recorded performance 18 may appear to the observer, such as a student musician, to be the same as pre-recorded performance 18 watched and/or heard by the studio musician discussed above with respect to FIG. 2, the video output of VCR 55 is also used as mass media input 12 and includes musical note assistance data 48 encoded on one or more preselected VBI scan lines.

Mass media input 12 is therefore applied to the video input of music controller 102 which may conveniently be a specially configured computer board positioned physically within keyboard/strummer 10 or attached thereto. Music controller 102 may also be a conventional desk top microprocessor including various sound boards and other add-in cards necessary to perform the functions described below. Mass media input 12 is processed within music controller 102 by VBI data decoder 104 which serves to locate the preselected VBI scan line and extract the multiple bytes of music assistance data therefrom. The operation of VBI data decoder 104 to decode digital data from the VBI scan line is performed in much the same general manner as used to encode this digital data thereon by the cooperation of horizontal sync detector 66, vertical sync detector 68, VBI scan line locator 76, start data transfer switch 80 and serial data adder 84 in microprocessor 60, all as described above with respect to FIG. 2. VBI data decoder 104 thereby serves to decode or recover music data line 100.

Music data line 100 is applied to auto input selection switch 106 which merely serves to apply the appropriate music data input from mass media input 12, network input 13, specialized media input 14, MIDI data input 15 or stand alone programming input 16, to instrument microprocessor 108. In the mass media mode being described, auto input selection switch 106 applies music data line 100 from mass media input 12 to instrument microprocessor 108 which receives the output of keyboard decoder 110 as a second input. Keyboard decoder 110 is connected to keyboard/strummer 10 and provides data to instrument microprocessor 108 concerning the manner and timing of the activation of the input devices on keyboard/strummer 10 by the student musician. The inputs provided by such activation will be described in greater detail below with respect to FIG. 4 but generally include the activation of function programming keys 39, keyboard section 36 and strummer 38.

Instrument microprocessor 108 generates audio output 112 applied to conventional audio output system 114 by audio synthesizer 116. Instrument microprocessor 108 may also provide a display output for the student musician on display output 118 which may conveniently be a conventional multi-line LED or liquid crystal display. In addition, instrument microprocessor 108 simultaneously provides an output in the form of network input 13 for connection to another instrument as well as an output in the form of MIDI data input 15 for use by other MIDI equipment, not shown, for recording, mixing, audio output or similar purposes.

In the mass media mode just described, pre-recorded performance 18 is presented to the student musician on music video display 56 while the audio output produced by playing keyboard/strummer 10 is controlled by music data line 100 which has been synchronized with pre-recorded performance 18 as described above with respect to FIG. 2. In particular, at an appropriate point in pre-recorded performance 18, the studio musician may have used keyboard track 40 and chords 44 to change the music scale and the chord in accordance with the studio musician's musical appreciation of pre-recorded performance 18. These tracks would have been encoded by microprocessor 60 onto the appropriate VBI scan line at that same point of time in pre-recorded performance 18. When music data line 100 is decoded within instrument microprocessor 108, and activation of keyboard section 36 and strummer 38 by the student musician is decoded by keyboard decoder 110, the appropriate audio is produced by audio output system 114.

In a simple example, if the studio musician laid down keyboard and chord tracks appropriate for a C major scale and an F chord at the beginning of a second movement of the music, then when pre-recorded performance 18 displayed at the beginning of the second movement, activation by the student musician of any key in keyboard section 36 would be interpreted by instrument microprocessor 108 to produce a corresponding note in the C major scale and activation of strummer 38 would produce an F chord.

It should be noted, using this example for illustration, that if the student musician activated the wrong key, a different key within the C major scale would be produced. This result may be much less discordant than would otherwise result from the playing of a wrong note. Similarly, if the student musician did not activate a key at the proper time, no note would be produced.

Returning now to the various modes in which keyboard/strummer 10 may be operated, if ROM pack 24 is inserted into ROM pack interface 120, musical note assistance data would be applied to auto input selection switch 106 from specialized media input 14. ROM pack 24 therefore serves as a general purpose input/output or I/O port between microprocessor 60 and keyboard/strummer 10. ROM pack 24 may serve as an expansion slot for microprocessor 60 while physically resident in ROM pack interface 120 which as noted herein may conveniently be located within keyboard/strummer 10. ROM pack 24 may also conveniently be used for providing data for upgrades or changes to the operation of keyboard/strummer 10 such as by use in upgrading or changing the programming of instrument microprocessor 108.

ROM pack 24 may also be used in cooperation with other modes of operation of this system. For example, as noted above with respect to FIG. 1, playable mass media 20 may be any kind of such media including a CD ROM. It is potentially difficult and/or expensive to add musical note assistance data to a pre-published CD ROM. One alternative, however, is to provide the note assist data corresponding to the CD ROM on a selected corresponding ROM pack 24. In addition, the highly accurate timing and synchronization available with the digitized musical data on the pre-published CD ROM may be advantageously used to provide additional desirable benefits. For example, data including information sufficient to identify a specific point early in the recorded performance, such as the first few bars or milliseconds of one or more tracks or songs pre-recorded on the CD ROM, together with relative timing information indicating when that data is played, may be recorded in a look-up table or directory within ROM pack 24. Mass media input 12 and specialized media input 14 including this look-up or directory data are applied to queuing comparator 121 which continuously compares data on mass media input 12 to determine correlation with the data stored in ROM pack 24 to determine which song is being played and when it starts.

If the mass media was a CD ROM, mass media player 55 would be a CD ROM player. Conventional CD ROM players often include the ability to select a particular track or song to be played. Queuing comparator 121 would then continuously compare the data stored within the look-up table to the sound or music data provided by mass media input 12 to detect the beginning of a song. The beginning of a piece of music being played may then be identified by correlation with the data in the look-up table or directory to identify the piece being played as well as the location within ROM pack 24 of the corresponding note assistance data. The output of queuing comparator 121 would then be applied to ROM pack interface 120 to select the appropriate note assist data corresponding to the piece being played.

The song mapping data in the music note assistance data in ROM pack 24 may therefore be synchronized with each song on a CD ROM. This is made possible by the very accurate and repeatable timing of each song played in a CD ROM, the fact that each copy of the same title of a CD ROM is identical to within about on part in 65,000 and the availability of accurate timing control by instrument microprocessor 108. In operation, keyboard/strummer 10 may therefore use data encoded on playable mass media 20, data encoded in ROM pack 24 synchronized with, and automatically queued, to match the song or track selected on playable mass media 20 or data available on ROM pack 24 that has been encoded from standardized music from other sources.

In addition, data from instrument microprocessor 108 may be added to ROM pack 24 before, during or after playing of keyboard/strummer 10. For example, the musician playing keyboard/strummer 10 may utilize musical note assistance data encoded for example on playable mass media 20 in the form of a video tape and make alterations or variations in the music produced by the manner in which the instrument is played. ROM pack 24 may include memory such as RAM which can be written to and then such variations may be preserved in ROM pack 24 by instrument microprocessor 108 by means of write back line 123. Many variations of the way in which the musical note assistance is encoded, recorded, modified and made available to the musician directly and/or by means of keyboard/strummer 10 are well within the skill of a person of ordinary skill in this art once the disclosure of the present invention has been made available.

If data from MIDI equipment 30 is applied via MIDI data input 15 to MIDI interface 122, then musical note assistance data would be applied to auto input selection switch 106 from MIDI data input 15. If data is applied by network input 13 to network interface 124, then musical note assistance data from network input 13 would be applied to auto input selection switch 106. In addition, stand alone instrument data 28 is applied by stand alone programming input 16 to auto input selection switch 106.

In this manner it can be seen that in particular applications, data from one or more inputs may be applied to auto input selection switch 106 simultaneously. Auto input selection switch 106 may therefore be pre-programmed to select from and/or combine the available data inputs in a desirable manner. For example, auto input selection switch 106 may be pre-programmed to treat the data available from the various inputs in a way reflecting the expected usage by the student player and therefore treat data from mass media input 12 as having the highest priority, network input 13 having the second priority followed by data from specialized media input 14 and then MIDI data input 15 with stand alone instrument data 28 from stand alone programming input 16 having the lowest priority. Various other combinations may be appropriate for different applications.

In operation of keyboard/strummer 10 in accordance with the present invention, the student musician activates a key or strummer input which is decoded by keyboard decoder 110 and applied to instrument microprocessor 108 which is programmed to respond to the actions of the musician in accordance with two different types of programming input data. The first type of programming data is the musical note assistance data discussed above.

The other type of data represents the action of the particular input mechanism. That is, the manner in which the keys of keyboard section 36 are played, or the manner in which the vanes of strummer 38 are strummed, is provided by keyboard decoder 110 to instrument microprocessor 108 and is used to control the music produced by audio output system 114. In a preferred embodiment, the speed of application and release of the force, the magnitude of the force and the position of the application of the force may all be used to input data to instrument microprocessor 108 to affect the music produced. In addition, the operation of instrument microprocessor 108 in the production of the musical output may be altered or adjusted by activation of one of the keys of function programming keys 39 to, for example, change the voice of the instrument.

Figure 5:
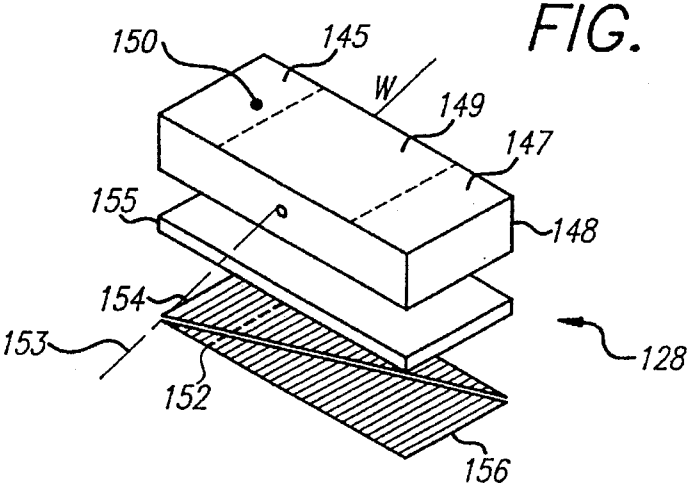
FIG. 5 is an exploded, isometric illustration of one of the key input assemblies of the keyboard portion of the keyboard/strummer depicted in FIGS. 1 through 3.
Figure 4:
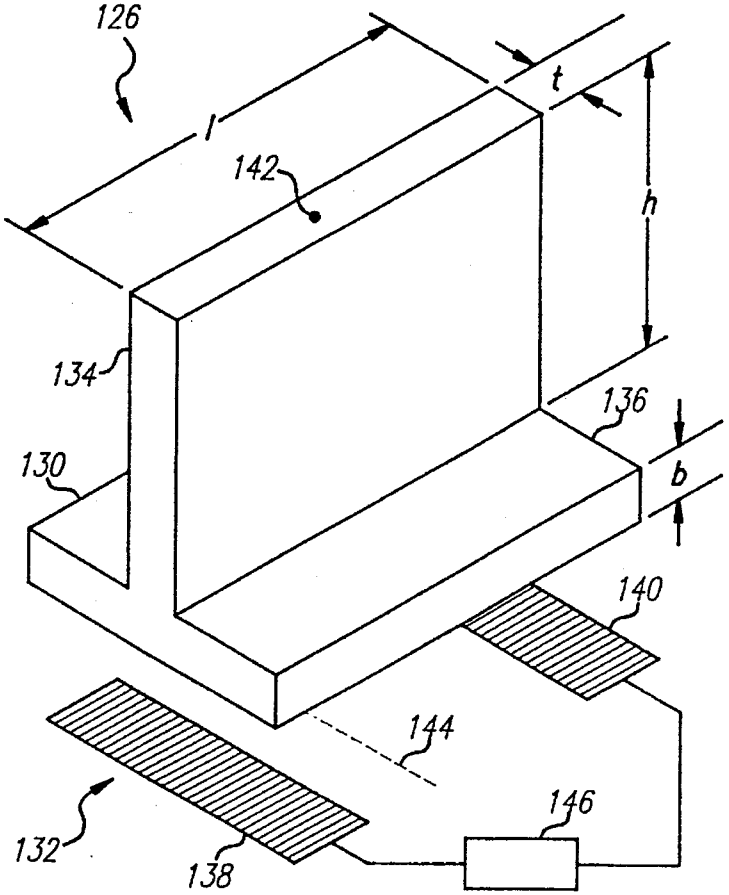
FIG. 4 is an exploded, isometric illustration of one of the six vane input assemblies of the strummer portion of the keyboard/strummer depicted in FIGS. 1 through 3.

The operation of keyboard section 36 and strummer 38 may be understood from the following more detailed description of vane input assembly 126 of strummer 38 shown in FIG. 4 and key input assembly 128 of keyboard section 36 shown in FIG. 5.

Referring now to FIG. 4, vane input assembly 126 is shown in an exploded view and is one of six identical vane assemblies which are combined to form strummer 38. Vane input assembly 126 may represent key vane 162 or 164 shown in FIG. 3 or any of the vanes therebetween. Vane 130 is a flexible, cantilever mounted inverted T shape made of an appropriately resilient material such as nylon. In a presently preferred embodiment, vane 130 has a length dimension '1' of about 6 inches, a thickness dimension 't' of about 0.03 inches, a height dimension 'h' of about 0.5" inches and a base dimension 'b' of about 0.3 inches.

Vane 130 is flexibly mounted above and in contact with sensor assembly 132 which is used to detect the manner is which vane extension 134 is physically activated by measuring the forces applied therefrom to vane mounting base 136 which is positioned in contact with sensor assembly 132. Sensor assembly 132 is a force and position sensor configured to detect the forces applied to vane extension 134 as well as to determine where, along length dimension '1', such forces were applied In addition to sensor assembly 132 sensing the activation of vane extension 134 by the musician, the mounting and materials used for vane extension 134 may provide a mechanical feedback or feel to the musician. That is, vane extension 134 is a torsion beam mounted in a cantilever fashion so that force is required to disturb the vane from its at rest position. The force varies with the distance from the rest position thereby providing a feel or touch feedback to the musician in a manner more consistent with original hand played instruments such as a guitar than is provided by music synthesizing instruments such as synthesizer keyboards.

In a preferred embodiment of the present invention, sensor assembly 132 is configured from a pair of force sensing resistors, called FSRs, such as rectangular FSRs 138 and 140 which are positioned in contact with opposite ends of the base of vane 130 as shown in FIG. 4. FSRs have the property that the resistance of the material changes in accordance with the force applied thereto and the surface area to which that force is applied. The FSRs are available in different configurations from Interlink Electronics of Carpinteria, CA. FSRs 138 and 140 are provided in a configuration in which the location of the force along the length dimension '1' is easily determined by comparison of the magnitudes of the forces applied to each such sensor. This determination is accomplished by force sensor decoder 146 which detects the total force applied to vane input assembly 126 as well as the relative portions of that force applied to each of FSRs 138 and 140.

In particular, a strumming force is applied to vane extension 134 at the position along length dimension 'l' shown in FIG. 4 as strumming point 142 by the student musician by plucking, strumming or bowing vane input assembly 126. The resiliency of vane extension 134 and its mounting, not shown, permits the majority of the force applied to vane extension 134 at strumming point 142 to be translated and applied to sensor assembly 132 along strum force line 144. As seen in FIG. 4, FSRs 138 and 140 are positioned in contact with opposite ends of vane mounting base 136.

At strum force line 144, the total force detected by force sensor decoder 146 is related to the sum of the forces detected by FSRs 138 and 140 while the relative position of strumming point 142 is detected by the relative magnitudes of the forces detected by each such FSR. As a simple example, it can easily be seen that a force applied to vane extension 134 near the end of sensor assembly 132 adjacent FSR 138 will result in almost all of the force being detected by FSR 138 while a force applied to vane extension 134 near the end of sensor assembly 132 adjacent FSR 140 will result in almost all of the force being detected by FSR 140. Similarly, a force applied to vane extension 134 in the middle of vane extension 134 would result in detection of approximately equal forces by FSRs 138 and 140. A force applied to strumming point 142 nearer to the end of vane extension 134 above FSR 138 and translated to strum force line 144 would therefore be detectable by the relatively larger force detected by FSR 138 and the relatively smaller force detected by FSR 138. In other applications, FSRs 138 and 140 may be configured differently to detect the applied forces differently.

Referring now to FIG. 5, key input assembly 128 operates in a manner similar to that described above with regard to vane input assembly 126 in that the force applied to key cap 148 at keystroke point 150 is translated to keystroke force line 152 by the flexible mounting of key cap 148, not shown. The magnitude of the force applied at keystroke point 150 is related to the sum of the forces detected by triangular shaped FSRs 154 and 156. The location of keystroke point 150 along width dimension 'w' of key cap 148 is determined by the magnitude of the force detected by FSR 154 compared to the magnitude of the force detected by FSR 156 at keystroke force line 152.

Triangular shaped FSRs 154 and 156 are generally symmetrical along an axis parallel with width dimension 'w' in a mirror image fashion. That is, at the end of key cap 148 shown nearest the base of triangular shaped FSR 154, triangular shaped FSR 154 has a substantially wider dimension parallel with width dimension 'w' than presented by triangular shaped FSR 156. Similarly, at the other end of key cap 148, triangular shaped FSR 156 has a substantially wider dimension parallel with width dimension 'w' than presented by triangular shaped FSR 154. The relative dimensions of the widths of triangular shaped FSRs 154 and 156 vary linearly along the axis of force sensor decoder 146 parallel with width dimension 'w'.

Triangular shaped FSRs 154 and 156 are shown as right isosceles triangles, normal to and mirror imaged about an axis parallel to width dimension 'w' so that a force applied to key cap 148 in the middle thereof would result in detection of approximately equal forces by triangular shaped FSRs 138 and 140. A force applied at keystroke force line 152 and translated to strum force line 152 would therefore be detectable by the larger force detected by triangular shaped FSR 154 and the relatively smaller force detected by triangular shaped FSR 156. In other applications, FSRs 154 and 156 may be configured differently to detect the applied forces differently. In the example shown, the width dimensions of triangular shaped FSRs 154 and 156 vary linearly with position. In other applications, it may be desirable for the width dimensions to vary non-linearly, such as in a logarithmic fashion, to suit the information to be detected by the FSRs.

In addition, force spreading pad 155 may be positioned between key cap 148 and triangular shaped FSRs 154 and 156 to diffuse and spread the force applied to key cap 148 for better detection by FSRs 154 and 156. A similar force spreading pad, not shown, may be used between vane mounting base 136 and sensor assembly 132 of FIG. 4 and/or with the alternate FSR configuration shown and described below in greater detail with respect to FIG. 7. Force spreading pad 155 may be fabricated from any suitable material, such as urethane rubber which is available from Rogers International of Rogers, Connecticut under the trademark "PORON".

Figure 6:
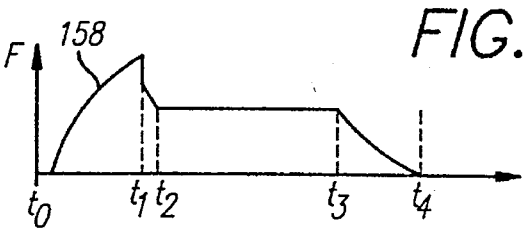
FIG. 6 is a graphical illustration of the effects of activating the keyboard inputs of the keyboard/strummer depicted in FIGS. 1 through 3.

Referring now to FIG. 6, graph 158 depicts the force applied to key cap 148, shown in FIG. 5, as a function of time for a key activation applied thereto at any position along width dimension 'w'. The initial period of time from t0 to t1 is known as the attack and represents the speed at which the force is increased as well as the magnitude of the force. In musical instruments, it is conventional to alter the sound volume produced in accordance with the velocity of the attack. That is, if key input assembly 128 is actuated briskly, instrument microprocessor 108 may conveniently be programmed to set the volume of the sound produced by actuation of this key to be louder than if the key is stroked gently. This is typical, for example, in piano voiced instruments.

The second period, from t1 to t2 is known as the decay in which the loudness of the initial response to the activation of the key decreases to a level indicated by the time period from t2 to t3, known as the sustain. During the sustain, the note is held, but at a lower volume than indicated by the speed of the attack. During the sustain period, the force applied may be varied to produce the musical effect known as after-touch in which the musical quality of the note produced may be varied in accordance with variations of the force with which the key is held before release.

From time t3 to t4, the force applied to key cap 148 is removed. In accordance with the present invention, instrument microprocessor 108 may be programmed to determine the speed of release as an additional piece of musical data, similar to the speed of the attack. The speed of release may easily be determined quickly and used to alter the music produced at the end of the sustain period. For example, in playing a first note, the musician striking key cap 148 may choose to attack briskly and release briskly. Instrument microprocessor 108 may then conveniently be programmed to produce a note which is both relatively loud and which stops abruptly at the end of the sustain as is normally the case in conventional instruments.

In particular, in accordance with the present invention, the manner in which the key is released is also available for changing the way in which the note is produced. That is, if key cap 148 is attacked briskly but released slowly, the slow release may result in an altered release musical effect such as reverberation. Alternatively, other musical effects may be controlled by the manner of the release, including tremolo or other effects. It is important to note that the manner in which the release occurs is used to control the musical quality during the period immediately following that release.

In addition to controlling musical qualities such as loudness, sustain, reverberation, tremolo and etc. by controlling the speed of attack, length of application of force and the speed of release, the musician may also control the tone of the note produced by the initial and subsequent locations on the keys to which force is applied. Bending graph 160 is an illustration of the effects of various application forces applied to key cap 148. Sweet spot 149 in the center section of keycap 148, as shown in FIG. 5, is designated as a "sweet spot" in which the note produced is exactly the note selected by the musical note assist data without regard to the level of force applied to keycap 148.

Outboard of sweet spot 149, however, the force applied to keycap 148 may be used to modify the note produced. When the force applied to outboard areas 145 or 147, on either side of sweet spot 149, is below first force threshold level FT1, these outboard areas operate in the same manner as sweet spot 149. That is, when a force below FT1 is applied to outboard areas 145 or 147, the note produced is the same as the note that would be produced if sweet spot 149 were activated. Similarly, if a force above second force threshold level FT2 is applied to one of the outboard areas, the note produced is the same as the note that would be produced if sweet spot 149 were activated. That is, if key cap 148 is activated in sweetspot 149 at any level of detectable force or in outboard areas 145 or 147 at force levels below FT1 or above FT2, the note preprogrammed by the note assist data will be produced.

In accordance with the present invention, however, if force is applied to outboard areas 145 or 147 at a level between first and second force threshold levels FT1 and FT2, the tone of note produce will be changed or bent. Both FT1 and FT2 are programmable levels and the range of maximum tonal change resulting from the application of a force at just below second force threshold level FT2 is also programmable. The change of tone may be further changed by the changing position of the application of the force and/or changing the magnitude of the force.

Figure 7:
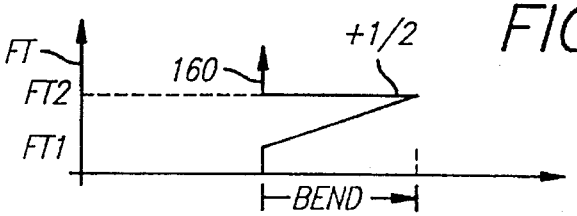
FIG. 7 is a graphical illustration of the force thresholds associated with activating the keys of the keyboard inputs outboard of the central sweet spot.

Referring now to FIG. 7, one convenient arrangement is illustrated by bending graph 160 in which a force at about the second force threshold level FT2 applied to the furthest outboard edge of outboard area 147 causes the tone of the note produced to be increased by half a step. Similarly, a force at about the second force threshold level FT2 applied to the furthest outboard edge of outboard area 145 would be programmed to cause the tone of the note produced to be decreased by half a step. In both instances, a force originally applied to either outboard areas 145 or 147 between first and second force threshold levels FT1 and FT2 would produce a note shifted from the sweetspot note in relationship to the displacement of the position of the application of the force from the sweetspot. Further, if the displacement of that force is changed during the application of the force to key cap 148, the tone would be bent, that is, the tone would change in accordance with the changing displacement.

In other words, striking the key softly or sharply will play the programmed note, while striking the key within the force thresholds but outside of the sweetspot allows the note to be bent or changed. If the key is struck within the force thresholds near the sweetspot and then moved toward the furthest end of outboard area 147, the tone would change from the preprogrammed note to a note one half step up, is the same manners as graphically illustrated in FIG. 7.

By selectively striking key cap 148 at one end or the other, the note played may therefore be chromatically shifted up or down one half tone. By sliding the point of application of the force to key cap 148 during the striking of the key, the tone may be continuously chromatically shifted or bent from one half step down through on half step up.

In an alternate embodiment, the bending and chromatic shifting is handled in a different manner. In this approach, the initial point of contact with the key determines whether bending or a chromatic shift may occur. If key cap 148 is first touched in sweetspot 149, the tone produced will be the preprogrammed tone. Moving the point of application out of sweetspot 149 to outboard areas 145 or 147 will cause the tone to bend up or down, respectively. The amount of bending, that is, the change in tone, is a function of force so that the tone may be bent more or less by applying more or less pressure to key cap 148.

In this approach, chromatic shifts occur if key cap 148 is first struck outside sweetspot 149 in outboard areas 145 or 147. For example, by striking outboard area 145 first, the tone produced may be shifted chromatically up one half step while first striking outboard area 147 would result in a tone shifted chromatically down by one half step. In this embodiment, the volume of the chromatically shifted tone is a function of the pressure applied just as it is for the sweetspot tone.

Referring now again to FIG. 4, vane input assembly 126 may be played by the musician differently than key input assembly 128 of FIG. 5. To better represent the sounds produced by the plucked strings of a guitar, for example, strummer 38 may be interpreted by instrument microprocessor 108 to produce the appropriate musical note in accordance with the musical note assistance data only when vane extension 134 is released. That is, the musician plucks vane extension 134 at strumming point 142 but no music is produced until the vane is released. The loudness, or another musical quality, may then conveniently be determined by instrument microprocessor 108 from the speed of the attack or the total magnitude of the force applied. That is, if vane extension 134 is moved from the at rest position only a relatively small distance, when released the music produced thereby may be at a relatively low volume. If, however, vane extension 134 is moved a much larger distance from its at rest position before release, the volume of the chord produced may be significantly louder.

There are several other ways in which strummer 38 may be utilized in a different manner than keyboard section 36. In addition to producing the note only when released, strummer 38 is programmed by the musical note assistance data to produce a cord of six notes so that keyboard/strummer 10 may be set up by function programming keys 39 to require each chord note to be played by plucking the appropriate vane for each chord note or by providing a key vane, such as key vane 162 shown in FIG. 3, which is used to activate the entire chord. That is, instrument microprocessor 108 may be programmed by activation of selected keys in function programming keys 39 so that plucking key vane 162 automatically produces the entire chord. Similarly, function programming keys 39 may be used to alter the position of the key vane from key vane 162 to key vane 164 as also shown in FIG. 3, so that keyboard/strummer 10 may easily be converted from a right handed to a left handed instrument.

Additionally, the position along length dimension '1' at which the vane activation force is applied may be used to alter the musical qualities of the chords produced in the same manner that the striking of key cap 148 of FIG. 5 along width dimension 'w' is used to bend the note produced. The musical quality affected by the positioning along length dimension '1' of strumming point 142 may be selected by function programming keys 39 to be bending of the note, loudness, sustain, after-touch qualities or any other musical quality controllable by instrument microprocessor 108 in the production of music from audio output system 114 of FIG. 3.

Alternatively, instrument microprocessor 108 may be programmed to respond to bowing of strummer 38 by a bow, not shown, in the manner that a violin is played by bowing.

In another embodiment, a particular mode such as the bowing mode, may operate in a different manner. That is, rather than having the tone produced only when the displaced vane is released and the volume of the tone produced being controlled by the magnitude of the displacement of the vane, the vane may be operated in a manner similar to the keys. That is, pressure on each vane will produce a tone or chord directly upon application, rather than release, with the volume a function of the magnitude of the pressure. Multi-mode operations are also convenient so that chromatic shifts, tone bending or other musical effects may be controlled by the position or change in position of the application of the force, as desired.

For example, while playing a conventional guitar, it is common practice to pluck one or more strings to produce a chord and rest the pick or musician's finger on the next string without playing it. This effect may easily be simulated by programming instrument microprocessor 108 so that displacement or pressure or speed of application or speed of release may be used to set a threshold for operation of a vane. For example, if the speed of release of a vane is below a programmable threshold, release of the vane may be programmed to not produce a chord or tone so that the vane may be used as a rest without producing an unwanted note.

An additional difference in the manner in which keyboard section 36 and strummer 38 may be operated is related to the timing of the activation of the input devices as described above for example with regard to FIG. 6. That is, by changing the position along width dimension 'w' of key cap 148 of FIG. 5, the tone of the note being played may be bent. In this way, the note is altered during playing. When strummer 38 is configured by instrument microprocessor 108 to begin playing the note when released, some alteration of the note qualities is under the control of the musician before release of the vane. In addition, the chords being played may also be muted by the musician by touching the vanes after release. That is, the musician may pluck the key vane to play the chord encoded by the musical note assistance data and then, before the end of the sustain, the musician may place his or her hand on the vanes of the strummer to prematurely stop or otherwise modify the playing of the chord.

Figure 8:
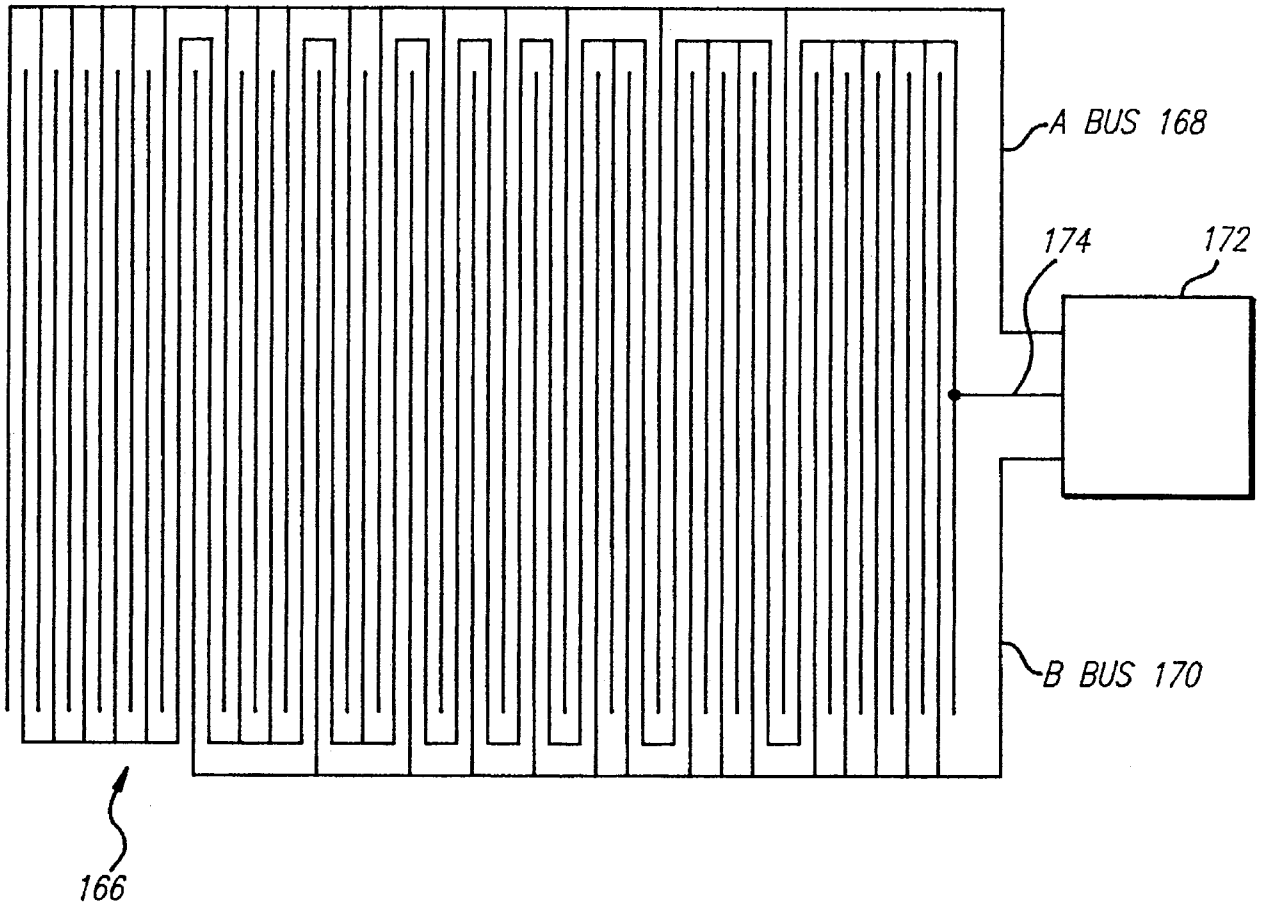
FIG. 8 is a schematic representation of a stepped FSR in accordance with the present invention.

Referring now to FIG. 8, a particularly convenient form of FSR, for use for example with key input assembly 128 of FIG. 5, is shown in schematic form as stepped FSR layout 166 which is formed of conductive tracing material on a suitable insulating substrate in the manner available from Interlink Electronics of Carpinteria, Calif. as noted above. Stepped FSR layout 166 includes a first or "A" bus trace 168 and a second or "B" bus trace 170 both of which are interlaced as shown in the figure and connected by sensor driver/detector 172.

In conventional operation of stepped FSRs, a voltage would be applied to a central line, such as read line 174 shown in FIG. 8, and the voltages appearing on "A" bus trace 168 and "B" bus trace 170 would be measured by sensor driver/detector 172. The voltages appearing on the busses would therefore depend upon FSR resistance as changed by the pressure applied. Thereafter, the pressure applied and the location of its application would be determined by computation, usually in separate steps.

In accordance with a preferred embodiment of the present invention, however, sensor driver/detector 172 may operate in a different mode in which voltages are applied, during two different steps, to the busses while the voltage appearing on read line 174 during one such step represents position and during the other step represents a force measurement.

In the position determining step or mode, substantially different voltages are applied to "A" bus trace 168 and "B" bus trace 170 such as by applying a fixed, convenient voltage to "A" bus trace 168 and grounding "B" bus trace 170. In addition, a relatively high fixed resistance is provided between read line 174 and one of the buses, such as "B" bus trace 170. When force is then applied somewhere along key cap 148, read line 174 becomes the wiper or central voltage of a resistor divider network one leg of which is the fixed resistance while the other leg is the resistance of the FSR. In this mode, the force is translated directly into changes in the magnitude of the resistance based on the interlaced pattern of "A" bus trace 168, "B" bus trace 170 and read line 174 without regard to the magnitude of the force. That is, the further towards the left as shown in the drawing that the force is applied, the greater the affect of the voltage applied to "A" bus trace 168 on read line 174 and therefore the position along key cap 148 at which this force is applied is easily determined as a ratio of the detected voltage to the voltage applied to "A" bus trace 168. That is, if the relative magnitude of the bus voltages and fixed resistance are properly selected, the voltage appearing on read line 174 will be primarily indicative of position without regard to the magnitude of the force.

On the other hand, in the force only step or mode which may conveniently be operated alternately with the position only mode, sensor driver/detector 172 operates to connect "A" bus trace 168 directly to "B" bus trace 170, applying a common voltage to both and effectively reducing stepped FSR layout 166 to a single bus pattern. When force is then applied along key cap 148, the magnitude of the resistance exhibited by the single FSR trace may easily be measure as an indication of the magnitude of the force applied, independently of the position along key cap 148 where that force was applied.

Referring again specifically to FIG. 5, an alternate version of key input assembly 128 may include pivot axis 153 about which key cap 148 is pivoted so that the key operates as a rocker only key in which no output is produced by pressure directly at the center of the key above pivot 153 while pressure at either end of the key produces a signal proportional to the force applied without providing information in that signal related to the position along the rocker only key cap at which the force was applied.

Sensor driver/detector 172 may be used to alternate stepped FSR layout 166 in between the pressure and position only steps or modes to conveniently provide the information required by instrument microprocessor 108 to which sensor driver/detector 172 is connected by keyboard decoder 110, shown in FIG. 3.

Figure 9:
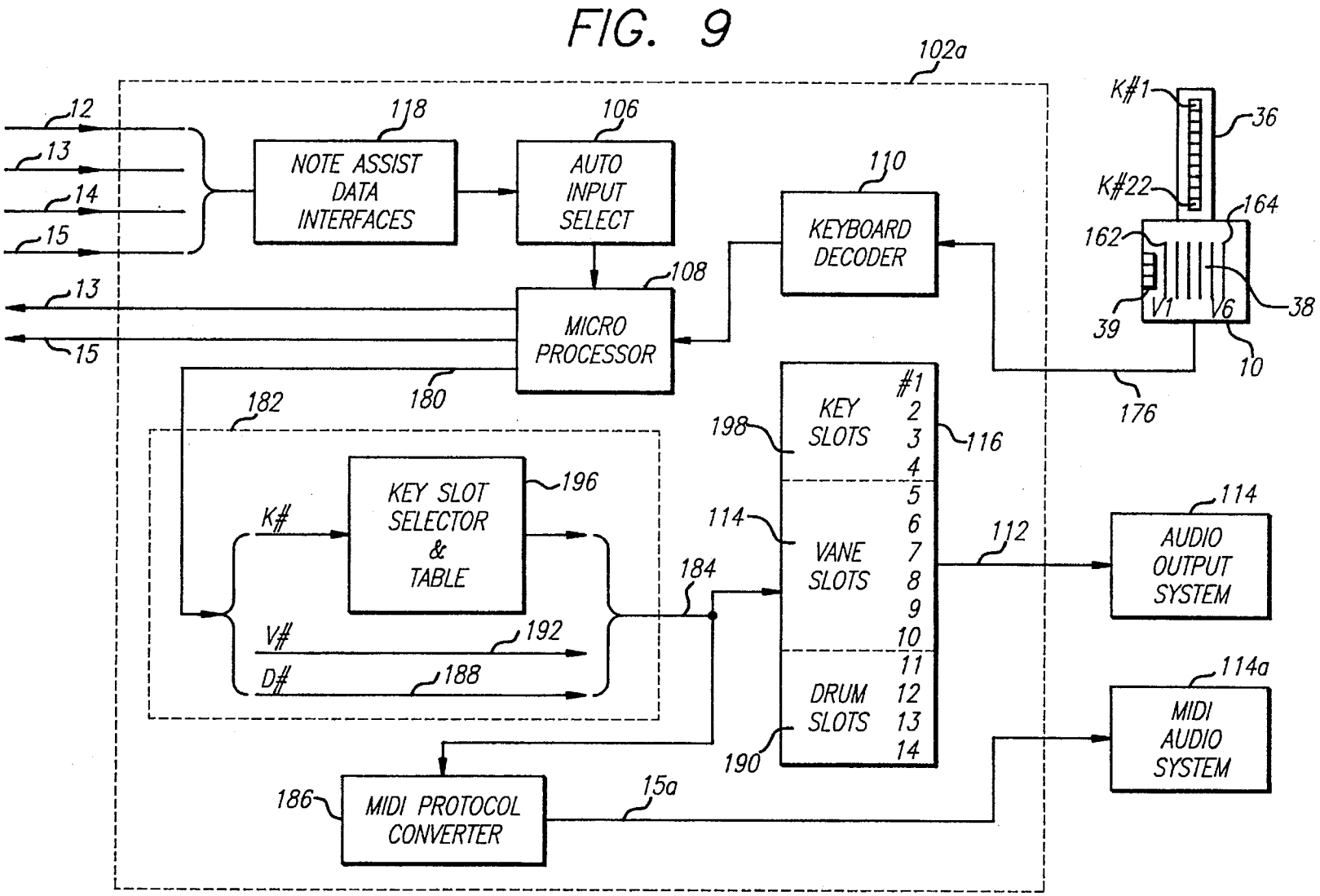
FIG. 9 is a block diagram illustration of a portion of an enhanced alternate embodiment of the keyboard/strummer shown in FIG. 3.

Referring now to FIG. 9, a block diagram illustration is provided of a portion of an enhanced alternate embodiment of keyboard/strummer 10 shown in FIG. 3. In particular, a portion of music controller 102 of FIG. 3 is shown in greater detail as music controller 102*a* for convenience in describing the operation of audio synthesizer 116 which provides audio output 112 used to produce music played through audio output system 114. In addition, music controller 102*a* provides for the production of MIDI data output 15*a* which may be used to produce music played by a conventional MIDI audio output system such as synthesizer 114a.

Music controller 102*a* may conveniently be contained within keyboard/strummer 10 and receive keyboard, vane and function key signal inputs from keyboard section 36, strummer 38 and function programming keys 39 via playing signal input 176 applied to keyboard decoder 110. Keyboard decoder 110 may conventionally be contained or implemented within instrument microprocessor 108 but is shown for convenience of description as a separate block within music controller 102*a*.

In addition, music controller 102*a* may receive note assist data in the form of mass media input 12, network input 13, specialized media input 14 and MIDI data input 15 all as shown in FIG. 3, as well as stand alone programming input 16 as shown in FIG. 1. These inputs may be applied via various interfaces and decoders, as shown for example in FIG. 3 as VBI data decoder 104, queuing comparator 121, ROM pack interface 120, MIDI interface 122, network interface 124 or similar devices, represented generally as note assist data interfaces 178 in FIG. 9. The various outputs available from note assist data interfaces 178 are selected and applied to instrument microprocessor 108 by auto input selection switch 106. The prioritization of the selection between the various sources represented by note assist data interfaces 178 may be aided by the inclusion of null data in the data stream. For example, if it preferable to select note assist data from a VBI decoding source, it is convenient to add null data codes to the note assist data encoded on the VBI intervals so that, even when no note assist data is being transferred from the VBI sources, the presence of the null data codes indicates that the VBI source is still connected and working. In this way, an unintentional deselection of a preferred source will not occur just because that source does not at that instant of time happen to have note assist data to be transferred.

Instrument microprocessor 108 provides network input 13 and MIDI data input 15 as outputs which may be applied to additional keyboard/strummers 10 or other devices as well as an output applied to audio synthesizer 116 for the production of music. In particular, as shown in detail in FIG. 9, instrument microprocessor 108 applies music data output 180 to channel selector 182 which produces internal synthesizer input 184 for audio synthesizer 116 to produce audio output 112 which is played by audio output system 114. In addition, if MIDI data output 15*a* from playing signal input 176 for the production of music by synthesizer 114a is desired, internal synthesizer input 184 may be applied in parallel to conventional MIDI protocol converter 186 as well as to audio synthesizer 16.

Audio synthesizer 116 may conveniently be a conventional synthesizer chipset, including both hardware interface and synthesizer chips, while channel selector 182 and MIDI protocol converter 186 may be implemented in the form of separate hardware devices or via appropriate programming within instrument microprocessor 108.

With regard first to channel selector 182, music data output 180 from instrument microprocessor 108 is conveniently in the form of key, vane and drum data including key, vane or drum number as well as pitch and volume information. The presently preferred music data output format includes the following three data items in each byte: <DEVICE>, <PITCH> and <VOLUME>.

Each <DEVICE> data item may represent the occurrence of the change in actuation status of any key within keyboard section 36 that has been pressed or released by the musician or any vane within strummer 38 that has been stroked by the musician or the production of a drum note as required by drum track 26 shown in FIG. 1. In particular, if keyboard section 36 includes twenty two separate physical keys, designated for convenience as K#1 through K#22, then the actuation or release of any particular key would require the production of a <DEVICE> data item in which a multibit sequence represented the key number.

For example, <DEVICE> would include a multibit sequence representing K#1 on when K#1 was pressed and a subsequent <DEVICE> data item would be provided on music data output 180 when K#1 was released. When the actuation status of a particular key is changed in a manner intended by instrument microprocessor 108 to produce or change a musical note, the <DEVICE> data item indicating that change would be followed by both <PITCH> and <VOLUME> data items providing the relevant pitch and volume information. When the actuation status of a particular key was changed in a manner intended by instrument microprocessor 108 to stop the production of a musical note presently being produced, for example by the release of the key, a <DEVICE> data item indicating the key number of the physical key that was released would be produced with a <VOLUME> data item representing zero volume, or off. In this situation, representing the intention to stop the production of a musical note, the <PITCH> data item may conveniently be ignored or not generated depending upon the architecture of the physical implementation of this data channel.

Assuming for example that keyboard section 36 included the above described keys K#1 through K#22, the <DEVICE> data format would require twenty two 32 different <DEVICE> data items, i.e. one for each physical key.

Similarly, six additional, different <DEVICE> data items are required to each represent each of the actual vanes within strummer 38 that may be stroked and/or released by the musician. For example, <DEVICE> would include a multibit sequence representing V#1 when V#1 was stroked and a subsequent <DEVICE> data item would be provided on music data output 180 repeating that multibit sequence when V#1 was released. When the actuation status of a particular vane is changed in a manner intended by instrument microprocessor 108 to produce or change a musical note, the <DEVICE> data item indicating that change would be followed by both <PITCH> and <VOLUME> data items providing the relevant pitch and volume information. When the actuation status of a particular vane was changed in a manner intended by instrument microprocessor 108 to stop the production of a musical note presently be produced, for example by the release of the vane, a <VOLUME> data item indicating zero volume would accompany the relevant <DEVICE> data item.

In the presently preferred embodiment, in addition to the twenty two actual keys and six actual vanes, four separate drum sounds channels are provided.

The twenty two different key related <DEVICE> data items, the six different vane related <DEVICE> data items and the four different drum sound related <DEVICE> data items may all easily be represented in five bit <DEVICE> data item.

It is important to note that the key and vane numbers within each of the <DEVICE> data items each represents a particular physical key or vane within keyboard section 36 or strummer 38, while the drum related <DEVICE> data items do not represent actual physical drum related actuators on keyboard/strummer 10 but rather drum sounds selected by the studio musician as indicated in drum track 26. In addition, function programming keys 39 may include keys the actuation of which causes one or more keys or vanes to represent such separate drum sounds or to produce a metronomic series of drum sounds.

In a simple, conventional type instrument system without the musical note assistance data of the present invention, the note to be played upon actuation of a particular key is fixed. That is, the relationship between each <DEVICE> data item and the note represented by the <PITCH> data item is fixed. Every time K#1 is depressed, for example, a particular note such as a C would be produced. In other, more complex conventional instrument systems, the relationships between the <DEVICE> data items and the notes to be played may be shifted or remapped by action of the user. For example, actuation of a programming key may cause some or all of the <DEVICE>to <PITCH> data item relationships to change so that actuation of K#1 may thereafter produce a different note, such as a C flat. Such mapping changes may also be controlled in a manner apparently transparent to the user. In the present invention, the mapping between <DEVICE> and <PITCH> data items is also changed by instrument microprocessor 108 in accordance with one of the note assist data inputs, provided for example on mass media input 12, network input 13, specialized media input 14 or MIDI data input 15 so that a series of keys or vanes are properly mapped for musical quality.

The <DEVICE>, <PITCH> and/or <VOLUME> data items produced by instrument microprocessor 108 are provided to channel selector 182 on music data output 180. In accordance with the presently preferred embodiment of the present invention, channel selector 182 applies these data items to audio synthesizer 116 via internal synthesizer input 184. A conventional fourteen slot, or fourteen channel, internal synthesizer chipset may conveniently used so that each of the six vanes and four drum notes may be applied to a separate, dedicated synthesizer slot leaving the four remaining slots available for use in producing musical notes representing actuation of four of the keys of keyboard section 36.

In practice, the use of four slots representing four out of twenty two keys has been found to be sufficient because it is rare that the musician would use more than four fingers of one hand to play keys of keyboard section 36. If all four slots dedicated to keys in keyboard section 36 are currently being used when another key is actuated, it is a simple matter to accelerate the decay of the note that has been playing the longest in one of those four slots so that slot may be turned off and the note related to the newly actuated key be applied to that slot when it is then made available.

The <DEVICE>, <PITCH> and <VOLUME> data items provided by instrument microprocessor 108 on music data output 180 are applied to channel selector 182 for distribution to the appropriate slots within audio synthesizer 116. In particular, data items related to drum notes are applied via drum note data path 188 and internal synthesizer input 184 to drum slots 190 which may conveniently be slots S#11 through S#14 of audio synthesizer 116. Similarly, data items related to the vanes within strummer 38 are applied via vane note data path 192 and internal synthesizer input 184 to vane slots 194 which may conveniently slots S#5 through S#10 of audio synthesizer 116.

<DEVICE>, <PITCH> and <VOLUME> data items provided by instrument microprocessor 108 on music data output 180 related to keyboard notes are applied by keyslot selector & table 196 in channel selector 182 through internal synthesizer input 184 to key slots 198 which may conveniently be slots S#1 through S#4 of audio synthesizer 116. The operation of keyslot selector & table 196 will be described below in greater detail with regard to FIG. 10.

As described above, data items related to each individual vane are applied to a vane slot 194 dedicated thereto. This advantageously permits the musical notes produced by the musician by actuation of a particular vane, such as key vane 162 of strummer 38, to always be produced by the same slot in audio synthesizer 116. For example, actuation of key vane 162 may be decoded by keyboard decoder 110 to cause a <DEVICE> data item related to V#1 to be produced by instrument microprocessor 108 on music data output 180. This <DEVICE> data item related, for example, to the vane data item referred to above as V#1, will then be applied via vane note data path 192 to S#5 within vane slots 194 of audio synthesizer 116 by internal synthesizer input 184. Similarly, the actuation of a different vane would result in the application of data to a different vane slot such as V#6.

The other data items associated with the musical note to finally be produced related to V#1, such as <PITCH> and <VOLUME> data items, are determined in part by the manner in which keyboard/strummer 10 is programmed, the manner in which key vane 162 is actuated and released, as well as the relevant note assist data, if any, related to that vane and provided to instrument microprocessor 108 by auto input selection switch 106 from the inputs applied to note assist data interfaces 178. In this way, many different variations of actually produced musical notes may be mapped onto the actuation of actuation of key vane 162 and applied as V#1 data to S#5.

Therefore, if key vane 162 is actuated by slowly striking the vane along its length and not released for a relatively long time, a large number of data items including V#1 data in their <DEVICE> data items may be produced. During the production of the musical note by audio output system 114 via the signals applied on audio output 112 from S#5, the relevant note assist data on, for example, mass media input 12 may well change indicating that the studio musician while creating chords 44 decided to map the actuation of key vane 162 to a different chords. In conventional MIDI format instruments in which mapping occurs, the MIDI note number originally produced by the actuation of key vane 162 must be memorized or stored so that MIDI note may turned off when key vane 162 is released even if the mapping has changed the note to be played.

That is, if key vane 162 when first actuated in a conventional system is mapped to produce MIDI note number 12, a MIDI note number 12 "note on" data item will be produced. MIDI note number 12 will then continue to be produced until a MIDI note number 12 "note off" data item is produced. If, as suggested above, the mapping for key vane 162 is changed during the time the musical note is actually being played to for example MIDI note number 13, release of key vane 162 will produce a MIDI "note off" for MIDI note number 13 which will result in the continued production of MIDI note number 12. That is, the mapping change could easily result in leaving MIDI note number 12 stuck on.

In order to avoid such "note stuck" problems, which result from the nature of the MIDI format in which serial data items or packets are related to the note to be played, conventional instruments store the relationship of the key actuated to the note numbers played. After mapping changes, the mapped MIDI note number "note off" data item must then be converted in accordance with the stored table of physical key to the earlier actuated MIDI note number so that the MIDI note number 12 "note off" data item will be produced by MIDI note number 13 "note of" data item in order to avoid causing stuck notes by mapping.

In the present invention, however, there is a direct correspondence between the vane being actuated, and the slot or channel in the synthesizer which is producing the note, so that there is no conversion necessary. That is, any actuation of key vane 162 produces a <DEVICE> data item related to V#1 which is always applied to S#5 in audio synthesizer 116 by channel selector 182. This conveniently permits a wide range of changes to be made to the note being played by actuation of a particular vane, such as by striking or strumming or sliding a finger tip along the vane edge, without regard to note changes influenced by mapping changes associated with the note assist data inputs applied by auto input selection switch 106.

Similarly, each drum sound is associated with a specific, dedicated one of the drum slots 190 of audio synthesizer 116 so that the same advantages are available of permitting musical changes from mapping or other without regard to storing or identifying the note previously produced. It may be convenient, however, to utilize more than four different drum sounds with only four slots. In particular, because the characteristics of drum sounds may vary widely, it may be advantageous to dedicate certain drum slots 190 to specific drum sounds while using the remaining drum slots in a non-dedicated manner.

For example, cymbal sounds have very different characteristics, such as decay times, for most other drum sounds. It may therefore be advantageous to dedicate one of the drum slots, such as S#14, for use with cymbal sounds while using the remaining three drum slots, S#11, S#12 and S#13, for more than three different types of drum sounds. This may be accomplished in the same manner that the twenty two keys of keyboard section 36 are applied to the four key slots 198, S#1 through S#4. This technique is described below in greater detail with regard to FIG. 10 and applies equally well to non-dedicated drum slots S#11 through S#13 described above.

The operation of keyslot selector & table 196 will next be described in greater detail with regard to FIG. 10 after which the operation of MIDI protocol converter 186 of FIG. 9 will be described and more conveniently explained.

Figure 10:
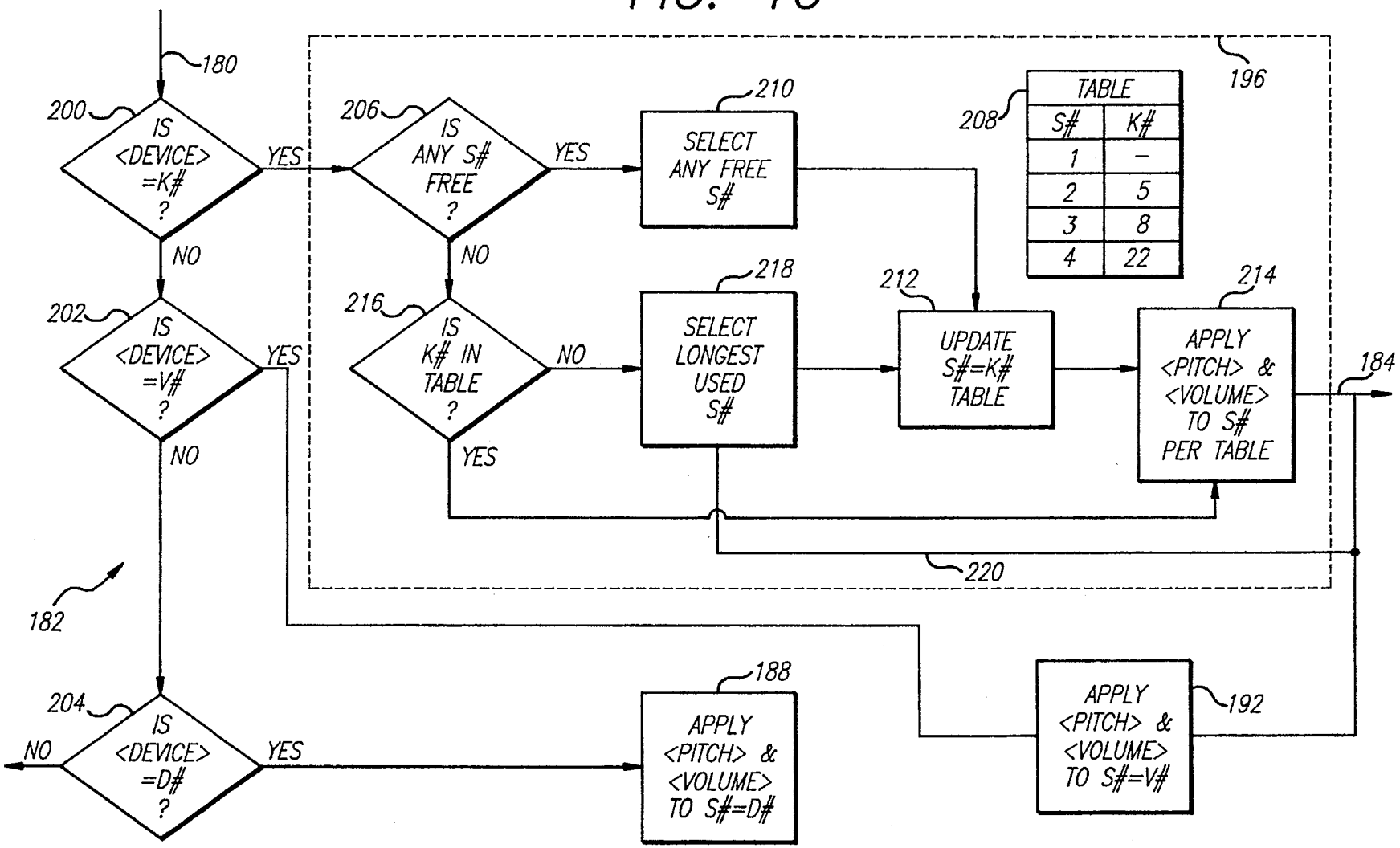
FIG. 10 is a flow chart block diagram of the operation of channel selector portion of the embodiment shown in FIG. 9.

Referring now to FIG. 10, the operation of channel selector 182, and particularly keyboard channel selector 196 contained therein, will be described in greater detail. As noted above, data items are provided by instrument microprocessor 108 to channel selector 182 via music data output 180. This data items are conveniently transmitted in a serial fashion and may be considered packets of data, each of which begins with, or at least includes, a <DEVICE> data item that indicates the actuator played by the musician on keyboard/strummer 10 at least for keys played on keyboard section 36 and strummer 38. That is, each data packet includes a <DEVICE> with a K# representing the physical key played, or a V# representing the vane actually played.

In addition, other voices may be mapped within keyboard/strummer 10 for keyboard section 36 and/or strummer 38 by means of function programming keys 39. For convenience of description, these other voices may be considered as part of the drum sounds represented in this description in data item or data packet with a D# which may represent an actual one of function programming keys 39 or at least a predetermined state of one of these keys.

These data packets are applied by music data output 180 to diamond 200 which determines if the <DEVICE> item in the data packet has a K#. If not, diamond 200 applies the data packet to diamond 202 which determines if the <DEVICE> item in the data packet has a V#. If not, diamond 202 applies the data packet to diamond 204 which determines if the <DEVICE> item in the data packet has a V#. If not, further processing may be provided for error correction or for use of other <DEVICE> types.

If diamond 204 determines that the data packet does include a <DEVICE> data item with a D#, that data packet is applied to drum note data path 188 which applies <PITCH>, <VOLUME> and any other relevant data items to the one of the drum slots 190 dedicated to that D#. For example, S#11 may be dedicated to D#1 so that <PITCH>, <VOLUME> and any other relevant data items in a data packet including a <DEVICE> equal to D#1 would always be applied to S#11 in audio synthesizer 116.

If diamond 202 determines that the data packet does include a <DEVICE>data item with a V#, that data packet is applied to vane note data path 192 which applies <PITCH>, <VOLUME> and any other relevant data items to the one of the vane slots 194 dedicated to that V#. For example, S#5 may be dedicated to V#1 so that <PITCH>, <VOLUME> and any other relevant data items in a data packet including a <DEVICE> equal to V#1 would always be applied to S#5 in audio synthesizer 116.

If, however, diamond 200 determines that the data packet does include a <DEVICE> data item with a K#, that data packet is applied to diamond 206 which determines if any of the four key slots 198 is free or available, i.e. not currently being used for the production of a musical note on audio output 112 by audio output system 114. This determination, as well as several other activities to be described, is accomplished by checking the contents of S# table 208, represented symbolically in FIG. 10. S# table 208 may easily be implemented a simple register or similar device in a memory or other portion of instrument microprocessor 108 or other convenient location in music controller 102*a* in which all four slots in key slots 198 have a position for the entry of a corresponding K# which may be changed under the control of keyboard channel selector 196.

In the particular state of S# table 208 depicted in FIG. 10, S#2 is being used to produce a musical note mapped to the physical key represented as K#5, while S#3 and S#4 are being used to produce notes mapped to K#8 and K#22, respectively. For convenience, any S# location in S# table 208 without a valid K#entry may be assumed to be free, because no valid note will be produced by audio synthesizer 116 thereby.

If one or more key slots 198 are free, diamond 206 causes block 210 to select any of the free S#s, such as the currently free S#1 shown in S# table 208, and block 212 is then used to update S# table 208 to reflect that the K# in the data packet being evaluated has been assigned to the selected S#. Block 214 is then used to apply <PITCH>, <VOLUME> and any other appropriate data items from the packet being evaluated to the specified S# in accordance with S# table 208. The specified S# slot in audio synthesizer 116 is then used to produce the desired musical note on audio output 112 for further processing, such as amplification by audio output system 114.

If at least one key slot 198 is not free, diamond 216 is then used to determine if the selected K# is currently in S# table 208. If so, block 214 is then used to apply the desired data to internal synthesizer input 184. These circumstances would arise, for example, if the data packet being evaluated included a <DEVICE>=K#5 statement. Evaluation of S# table 208 as shown indicates that S#2 is currently producing a musical note assigned thereto by an earlier data packet. The current data packet may contain, for example, a change of <PITCH>, <VOLUME> or other data which is accomplished by applying the data packet to S#2 which is presently assigned to K#5.

If, however, diamond 216 determines that in accordance with the information stored in S# table 208, none of the key slots 198 are currently assigned to the K# of the <DEVICE> item being evaluated, one of the key slots 198 must be made free by block 218 so that the musical note may be produced by audio synthesizer 116. Although many different algorithms may be used to determine which of notes currently being played should be terminated in order to provide a free synthesizer slot in which the new note may be created, the most convenient selection process is to simply selected the least recently used or altered slot. In other words, the slot that has been used the longest to play the current note. In most circumstances, the note that was least recently changed, or changed at the furthest time in the past, is likely to be the least important of the notes being played.

S# table 208 may then be updated by block 212 so that the selected one of key slots 198 to now be used for the current data packet is shown to be assigned to new physical key. For example, if K#5 had been the first of fours keys played which are still currently being used to produce a musical note, S# table 208 would be updated to reflect S#2=K#6 upon receipt of a data packet containing the statement <DEVICE>=K#6.

In this manner, it can be seen that vanes and drums are mapped to preselected synthesizer slots, while data for keys used to produced a musical note in an unassigned slot are stored in a simple table. When mapping changes resulting from note assisted data inputs cause changes in the musical note associated with a key, vane or drum, the previously produced note will not remain playing. This is conveniently and efficiently accomplished by designating preselected channels or slots for certain actuators such as vanes and storing a simple K# representing the physical key that was originally assigned to that slot rather than by requiring that the note value of all notes currently being play are stored so that the notes may be turned off.

It may, in certain circumstances, be convenient to also provide a "key off" data item from block 218. That is, when the slot to be deactivated is selected by block 218, in addition to updating S# table 208 by means of block 212 an additional data packet including <DEVICE>=K#5 and <VOLUME>=0 may be provided on key off data line 220 to internal synthesizer input 184.

The use of key off data line 220, which may alternately be provided by S# table 208, to add a key off packet to internal synthesizer input 184 permits the use of MIDI protocol converter 186 in parallel with audio synthesizer 116 if, for example, it is desired to produce musical notes with an audio system such as external MIDI synthesizer 114*a* which accepts MIDI format data rather than actual audio data. The operation of MIDI protocol converter 186 and synthesizer 114*a* will now be described in greater detail.

Referring again then to FIG. 9, internal synthesizer input 184 may be applied to MIDI protocol converter 186 in parallel with its application to audio synthesizer 116 in order to produce MIDI data output 15*a*, if desired. The system according to the present invention works completely and properly without providing MIDI out information because audio output 112 is produced by audio synthesizer 116 without the use of MIDI data within keyboard/strummer 10 and/or music controller 102 shown in FIG. 3 or music controller 102*a* shown in FIG. 9, either of which may in actuality be physically contained within keyboard/strummer 10.

However, it is useful and desirable to provide MIDI compatibility so that MIDI data may be used to provide note assisted data input in the form of MIDI data input 15 and/or keyboard/strummer 10 produce MIDI data output representing audio output 112, in the form of MIDI data output 15*a*. MIDI data output 15*a* may be produced by conventional commercially available devices which convert audio input from audio output 112 or audio output system 114, but it is convenient to provide MIDI data output 15*a* directly from music controller 102*a* so that the music produced by keyboard/strummer 10 may be played by a MIDI synthesizer 114*a* if audio output system 114 is not available or desirable. In addition, if further processing of the music produced by keyboard/strummer 10 is desired, for example for editing, then it may be very convenient to produce MIDI data output 15*a* from music controller 102*a* in parallel with audio output 112.

Referring again to FIG. 9, it is convenient to produce MIDI data output 15*a* from the information provided on internal synthesizer input 184 because all the required information is available thereon. The information available on internal synthesizer input 184 is, however, in a specialized format compatible directly with audio synthesizer 116 rather than the MIDI format. In particular, in addition to the differences in the way the binary data is actually presented, the data used within music controller 102*a* for operation of audio synthesizer 116 keeps track of the music being played in accordance with the physical actuator that was operated by the musician while the MIDI data format keeps track of the music being played in accordance with the note number assigned by the MIDI protocol to the musical note being played.

For example, as shown in FIG. 10, S# table 208 stores a cross reference between the slot number, or S#, of audio synthesizer 116 being used to play a musical note and the key number, or K#, of keyboard section 36 the actuation of which caused the production of the note by audio synthesizer 116. MIDI protocol converter 186 may therefore be used to both convert the data to MIDI format and change the S# designation to a MIDI channel number. In other words, any data packet on internal synthesizer input 184 directed to S#1, for example, may simply then be directed to MIDI channel number 1. In this way, the <DEVICE> data item is converted by channel selector 182 into a slot number data item for use in audio synthesizer 116 and that same slot number data item may be further converted, in MIDI protocol converter 186, into a MIDI channel number designator. Similarly, the <PITCH> data item associated with each <DEVICE> data item may be converted to represent a MIDI note number and the <VOLUME> data item converted into a MIDI volume number.

The specific implementation of MIDI protocol converter 186 depends upon the detailed implementation of music controller 102*a*, particularly on the data format requirements of the particular chipset used for implementation of audio synthesizer 116. It is, however, well within the skill of a person having ordinary skill in this art to code the software necessary to implement MIDI protocol converter 186 once the data format used on internal synthesizer input 184 for operation of audio synthesizer 116 is known.

Many other data items, in addition to the <DEVICE>, <VOLUME> and <PITCH> data items discussed above are used with conventional synthesizers, such as audio synthesizer 116 and in MIDI systems. One specific additional type of data item, related to the maximum volume of a particular channel or slot, is used advantageously in accordance with the present invention, particularly with dedicated slots such as vane slots 194. Vane slots 194 are considered dedicated slots in that each particular vane such as key vane 162, referenced above as V#1, is applied to control the output of one particular vane slot 194, such as V#5. The <VOLUME> data item used with conventional synthesizers, including MIDI and non-MIDI synthesizers, controls the volume produced in a channel or slot as a function of the percentage of the maximum channel or slot volume.

In addition, the maximum slot or channel volume for each individual channel or slot is itself controlled by a separate data item referred to herein as the <Max-S#> data item. It is common for the <Max-S#> data item to be set at initialization of the system for each channel and then controlled infrequently thereafter as part, perhaps, of an overall system volume setting or adjustment. In conventional systems therefore data items for <Max-S#1> through <Max-S#14> would normally be applied to audio synthesizer 116 to set the maximum value of volume on a per channel, channel specific basis.

For example, in a MIDI system, later <VOLUME> data items, related to a particular note being played, would then be applied through MIDI protocol converter 186 via MIDI data output 15*a* to MIDI synthesizer 114*a* so that the volume of that note would be set as a percentage of the maximum volume then available from that channel. It is therefore convenient, because the particular channel to be used to produce a particular note is not normally known when the <VOLUME> data item is produced, to set the maximum value for the channels of a MIDI synthesizer all to the same value.

With regard however to audio synthesizer 116 shown in FIG. 9 of the present invention, at least some of the slots are dedicated to particular actuators as noted above. This permits an additional set of uses for the <Max-S#> data items. For example, to provide a bowing type effect for playing key vane 162, it is advantageous to use an initial <Max-S#5> data item to set the volume of V#5 to zero or a very low value. Then the <PITCH>, and or <VOLUME>, data items produced by actuation of key vane 162 and the appropriate note assist mapping input, may be applied to V#5. Strummer 38 includes force transducers which almost continuously detect the forces applied to each vane, and where along the vane such forces are applied, so it is an easy matter to produce bowing effects by varying <Max-S#5> data items so that the volume of the musical note produced by actuation of the vane may rise, and/or fall, simulating the bowing of the vane. Other similar effects may also be conveniently controlled note specific, rather than channel specific, data items to be used for such effects, limiting the effects that can be produced and increasing the overhead processing burden required to produce such effects.

Referring now to synchronization, the techniques for synchronizing the note assisted operation or playing of keyboard/strummer 10 with the presentation of the original performance being viewed by the musician, so that the musician may play along with the performance, may be different for different media inputs.

For example, as described above with regard to FIG. 2, the note assisted mapping input may be provided on a video tape, or CD ROM, which is played in VCR/CD ROM player 55 to produce mass media input 12 for presentation of the performance on a conventional video monitor such as music video display 56. Mass media input 12 is also applied to VBI data decoder 104 to produce music data line 100 which is applied via auto input selection switch 106 to instrument microprocessor 108. Activation of keyboard section 36 and/or strummer 38 by the musician is detected by keyboard decoder 110 and mapped in accordance with music data line 100 to produce musical output, such as audio output 112.

As also discussed above with regard to FIG. 2, it is convenient to apply the note assisted data to the original performance recorded on video media by encoding the mapping data within the VBI or vertical blanking intervals, that is, the time between frames of video display during which the video is blanked to permit repositioning of the video excitation in the vertical direction. The use of the VBI for encoding of the mapping data provides inherent synchronization between the video performance and the note assisted mapping data in that the VBI intervals are inherently synchronized with the video frames being displayed and therefore, of course, with the audio portions of the performance with are produced at the same time.

Figure 11:
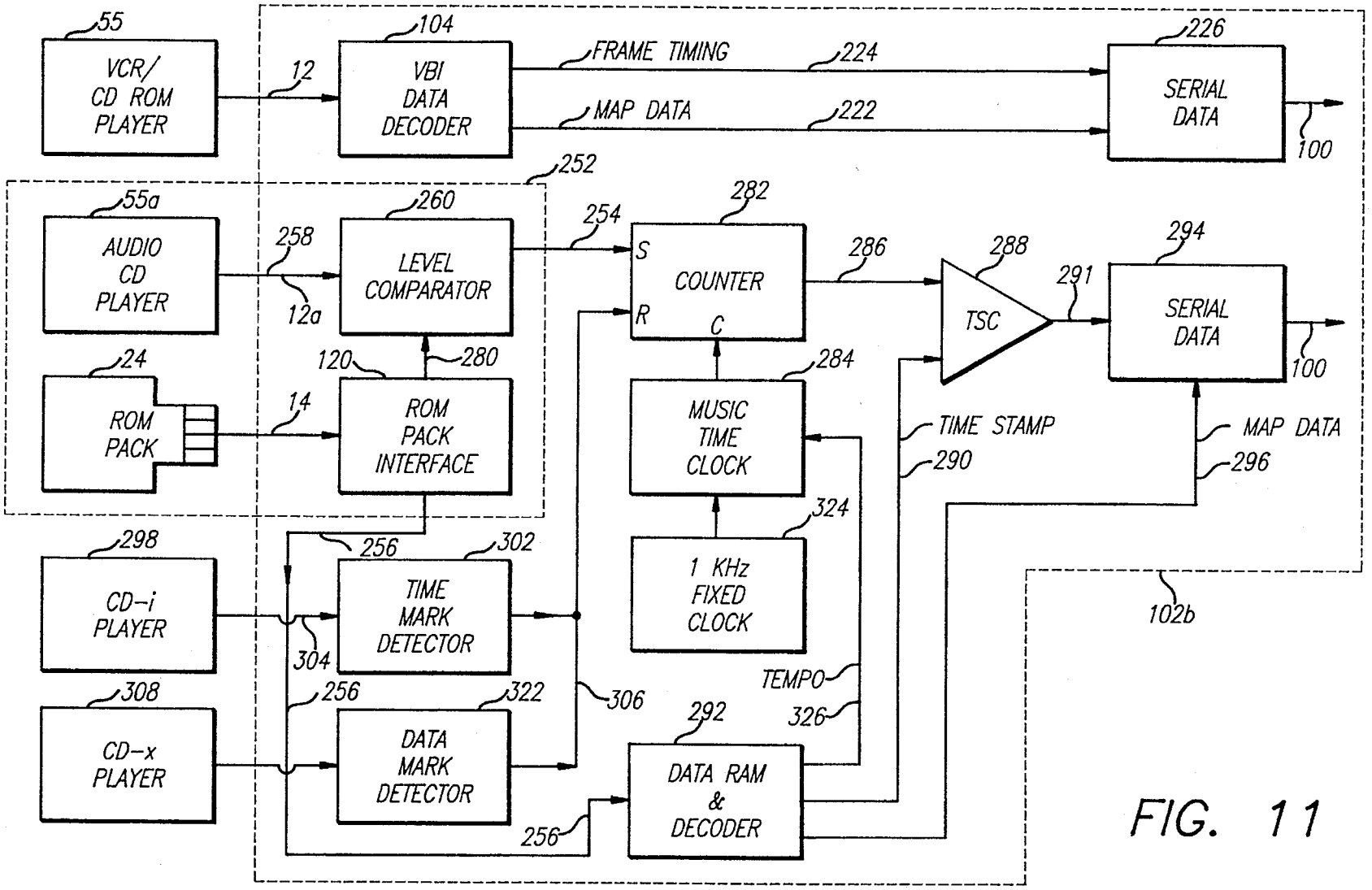
FIG. 11 a block diagram illustrating the operation of a portion of the music controller of a preferred embodiment of the keyboard/strummer.

Referring now also to FIG. 11, in which the interconnections between VCR/CD ROM player 55, CD player 55*a*, ROM pack 24, CD-i player 298 and CD-x player 308 with a portion of music controller 102 and 102*a* is illustrated music controller portion 102*b*, music data line 100 decoded by VBI data decoder 104 from mass media input 12 may be considered to include both note assisted mapping data 222, that is the data which specifies the mapping correlation between the key or vane actuated and the musical note to be produced, as well as frame timing data 224 which specifies the timing, with regard to the display of the pre-recorded original performance, of such mapping. Mapping data 222 and timing data 224 may conventionally be separate or integral portions of either a parallel or serial data stream, but are indicated for convenience of discussion as separate data lines applied to serial data device 226 to produce music data line 100 as a serial data stream for application to instrument microprocessor 108 via auto input selection switch 106.

The function of serial data device 226 may be inherent within the operation of VBI data decoder 104, included therein or be considered part of auto input selection switch 106 for consistency with the later descriptions of synchronization techniques useful for other types of media inputs.

Figure 12:
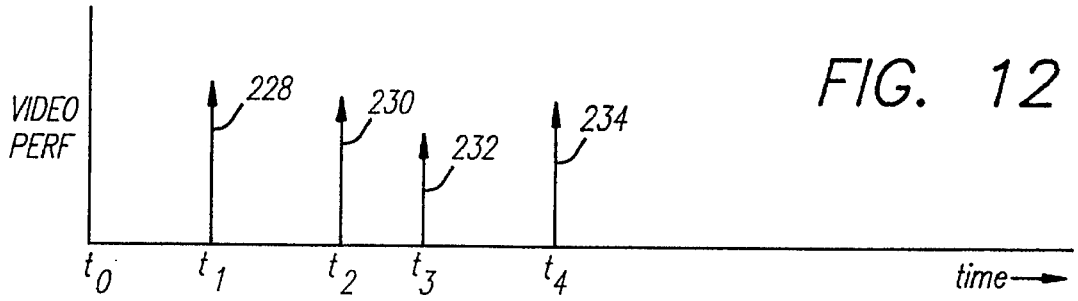
FIG. 12 is a timing diagram illustrating exemplar musical events in a particular pre-recorded performance for comparison and explanation of other figures.
Figure 13:
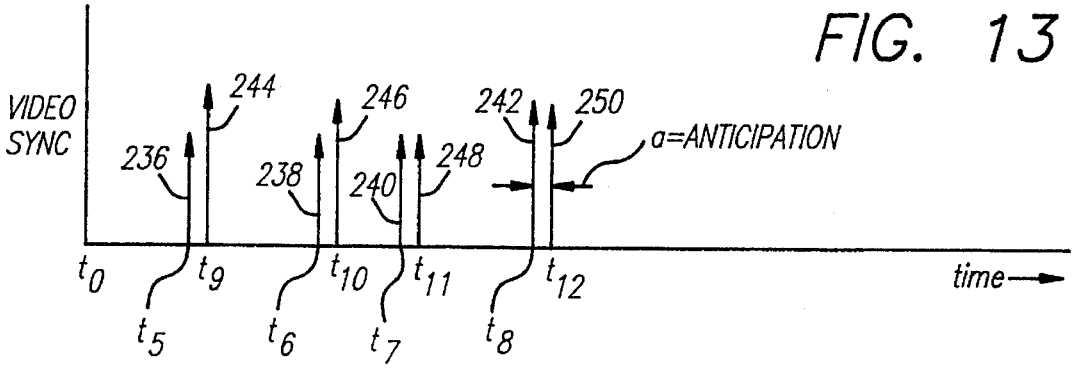
FIG. 13 is a timing diagram showing the anticipation of the mapping events when compared to the occurrence of musical events associated therewith and illustrated in FIG. 2 above.

Referring now to FIG. 12, a graphical representation is presented of the timing of musical events 228, 230, 232 and 234 in the pre-recorded performance at performance times t1, t2, t3 and t4. Musical events 228, 230, 232 and 234 may be notes, chords, drum beats or the like. Referring now also to FIG. 13, mapping events 236, 238, 240 and 242 are shown, in another graphical representation using the same time scale, as occurring at mapping times t5, t6, t7 and t8. Mapping events 236, 238, 240 and 242 represent the mapping of instrument microprocessor 108 to respond to playing of keyboard/strummer 10 by a musician. For example, if the original performance included the playing of the note "C" as musical event 228 at time t1, mapping event 236 represents the mapping by the studio musician by means of performance encoder 32 as discussed above, particularly with regard to FIG. 1, so that activation of a key within keyboard section 36 would produce an appropriate note at least compatible with if not the same as the note "C" played by in pre-recorded performance 18.

It is extremely important to notice that mapping event 236 occurs earlier in time than musical event 228. That is, mapping event 236 precedes musical event 228 by an amount of time which may conveniently be called anticipation. In accordance with the present invention, it has been found that anticipation is a very desirable attribute which enhances the quality of audio output 112. In conventional user mapped instruments in which the musician activates a function key or other device to change the mapping of a keyboard key to then be played, anticipation is not required because the musician knows that the mapping will not take effect until the function key is activated. This is not a problem because the normal sequence would be to actuate the function key and then the keyboard key.

The lag between actuation of the function key and the keyboard key prevents the musician from producing an unintended note, that is, a note without the desired mapping. It is possible in such systems that the musician could actuate the keyboard key simultaneously with or even slightly before the function key so that the intended mapping would not result, but this is both unlikely and under the musician's control so that it would be considered operator error and would be corrected by the musician playing differently. However, in techniques in which the user does not perform the mapping function such as in the case of the present invention in which the mapping is predetermined by the note assisted data input, the key must be mapped to the desired note before actuation of the keyboard key by the musician. That is, the mapping must anticipate the playing so that the playing produces music in accordance with the desired mapping.

The magnitude of the required anticipation is dependent upon both the music and the playing musician. A highly skilled musician playing a fast series of notes in a riff may prefer very little if any noticeable anticipation while a student musician playing a difficult piece may well prefer more anticipation. Similarly, in a typical performance, more anticipation may be preferred for certain tracks than others. For example, while substantial anticipation may be desired for playing the chords of the music, less anticipation may be preferred for playing the melody and base tracks while, for obvious reasons, drum beats played as performance data without intervention by the playing musician would not benefit from anticipation.

For these reasons, it is desirable to provide different levels or magnitudes of anticipation selected by either the studio musician and/or the playing musician. In the following discussion, the anticipation described may be considered the maximum anticipation. The actual anticipation used in particular instances will be selectable by the studio and/or playing musician as for example a percentage of the maximum anticipation. This selection may be made by the playing musician before or during a playing session by appropriate interaction with keyboard/strummer 10 by, for example, use of function programming keys 39 as shown in FIG. 1. In a typical embodiment using VBI interval encoding, a maximum anticipation of about 3 frames of video data has been found to be sufficient.

In order to better understand the need for and use of anticipation, consider the following example. The playing musician playing keyboard/strummer 10 might produce playing events 244, 246, 248 and 250 at playing times t9, t10, t11and t12 in response to viewing and/or listening to musical events 228, 230, 232 and 234 of pre-recorded performance 18. Although juxtaposition of FIGS. 12 and 13 indicate that playing times t9, t10, t11 and t12 occur exactly at the same times as mapping times t5, t6, t7 and t8, respectively, this is dependent upon the timing of and under the control of the musician playing keyboard/strummer 10. If all the playing times t9, t10, t11 and t12 were to be forced or controlled by instrumentation to occur at performance times t1, t2, t3 and t4 the audio output would be less pleasing as an artistic performance of the musician playing keyboard/strummer 10 and more of a mechanical reproduction of pre-recorded performance 18 varied only by notes being hit rather than by both the selection of the notes and the timing of their playing.

Although operation in this mode in which the playing times are forced to occur, or at least appear to have occurred, at the performance times, may be desirable for less skilled musicians, or for special effects, or for particular types of musical notes such as drum beats, it is expected that the relationship between the times of occurrence of the playing times with respect to the performance times will under most circumstances be left to the discretion, and abilities, of the musician playing keyboard/strummer 10.

However, mapping times t5, t6, t7 and t8 of mapping events 236, 238, 240 and 242 must anticipate playing times t9, t10, t11 and t12 of playing events 244, 246, 248 and 250 at least for a reasonable range of timing for the musician playing keyboard/strummer 10. For this reason, mapping times t5, t6, t7 and t8 are caused to precede performance times t1, t2, t3 and t4 by predetermined times so that the desired note assisted mapping occurs when the key or vane is played. The magnitude of the predetermined mapping anticipation may be constant, determined by the studio musician during performance encoding or by selection before playing by the musician playing keyboard/strummer 10. In each of this cases, the amount of anticipation may also be varied for enhanced musical performance or other effects as a function of the type of musical events depicted in FIG. 12 as musical events 228, 230, 232 and 234. In a typical situation, the anticipation would likely be sufficient so that desired musical note was produced in audio output 112 if musical event occurred at approximately the same time as the performance event. That is, there must be sufficient anticipation so that the output is properly mapped if the musician plays the note on keyboard/strummer 10 at the same time it is played in pre-recorded performance 18.

Returning now to FIG. 11, the above described synchronization between mapping data 222 and timing data 224 within music data line 100 is inherent in mass media input 12 because the mapping data is encoded in VBI intervals which by their nature are synchronized with pre-recorded performance 18. The anticipation described above may be applied conveniently during the performance encoding described above for example with regard to FIG. 2. For other media, in which VBI intervals or other data intervals having a fixed synchronization to pre-recorded performance 18 are not available or not used, other synchronization techniques must be applied to maintain synchronization of timing and mapping data.

For example, rather than using a CD ROM in which note assist data input has been added to pre-recorded performance 18, it may be desirable to utilize unmodified CDs, either audio or video CDs. For convenience of the following discussion, common music CDs, or audio CDs, will be used as the exemplar for unmodified mass media. Because the unmodified or audio CDs are not modified to include note assisted data input, the mapping data must be provided from another source. As discussed above for example with regard to FIG. 3, ROM pack 24 may be inserted within ROM pack interface 120 of keyboard/strummer 10 to provide specialized media input 14 which includes the appropriate mapping data.

As described above with regard to FIG. 2, ROM pack 24 may be used to store preselected data related to pre-recorded performance 18, such as the first few bars of a song, in a look-up table or other directory. This preselected data may then be applied to queuing comparator 121, as described above, for comparison with similar data or music on pre-recorded performance 18 in order to provide synchronization. In a presently preferred embodiment of the present invention, queuing comparator 121 may be implemented in the form of an audio level comparator as described below.

Referring therefore again to FIG. 11, synchronization techniques for audio CDs and other unmodified media are described with regard to unmodified media subsystem 252 which produces timing data in the form of enable pulse 254 which is synchronized with mapping data 256 in response to mass media input 12*a* from CD player 55*a* under the control of specialized media input 14 from ROM pack 24 inserted within ROM pack interface 120.

It should be clearly noted that mapping data 256 includes relative timing data, for example, in the form of time stamped or <Time Stamp> data items, within the serial data item packets including the other mapping data items such as the <DEVICE>, <VOLUME> and <PITCH> data items. <Time Stamp> data items represent the time at which a particular mapping event is intended to occur, but must somehow be synchronized with the playing of pre-recorded performance 18 to permit the musician to play along with that performance. For example, one particular <Time Stamp> data item would include data related to mapping time t5, for mapping event 236. Mapping time t5 is however a relative time compared to some starting or other identified time shown in FIGS. 12 and 13 as time t0. The problem is therefore to synchronize the t0 time of the note assisted or mapping data with the t0 time of pre-recorded performance 18.

Most unmodified media do not conveniently provide a predetermined, generally recognized timing mark which may be used as time t0 for both mass media input 12*a* and specialized media input 14. In accordance with the present invention, however, a timing mark may be selected for each pre-recorded performance 18 and/or song within each such performance, as described below.

Figure 14:
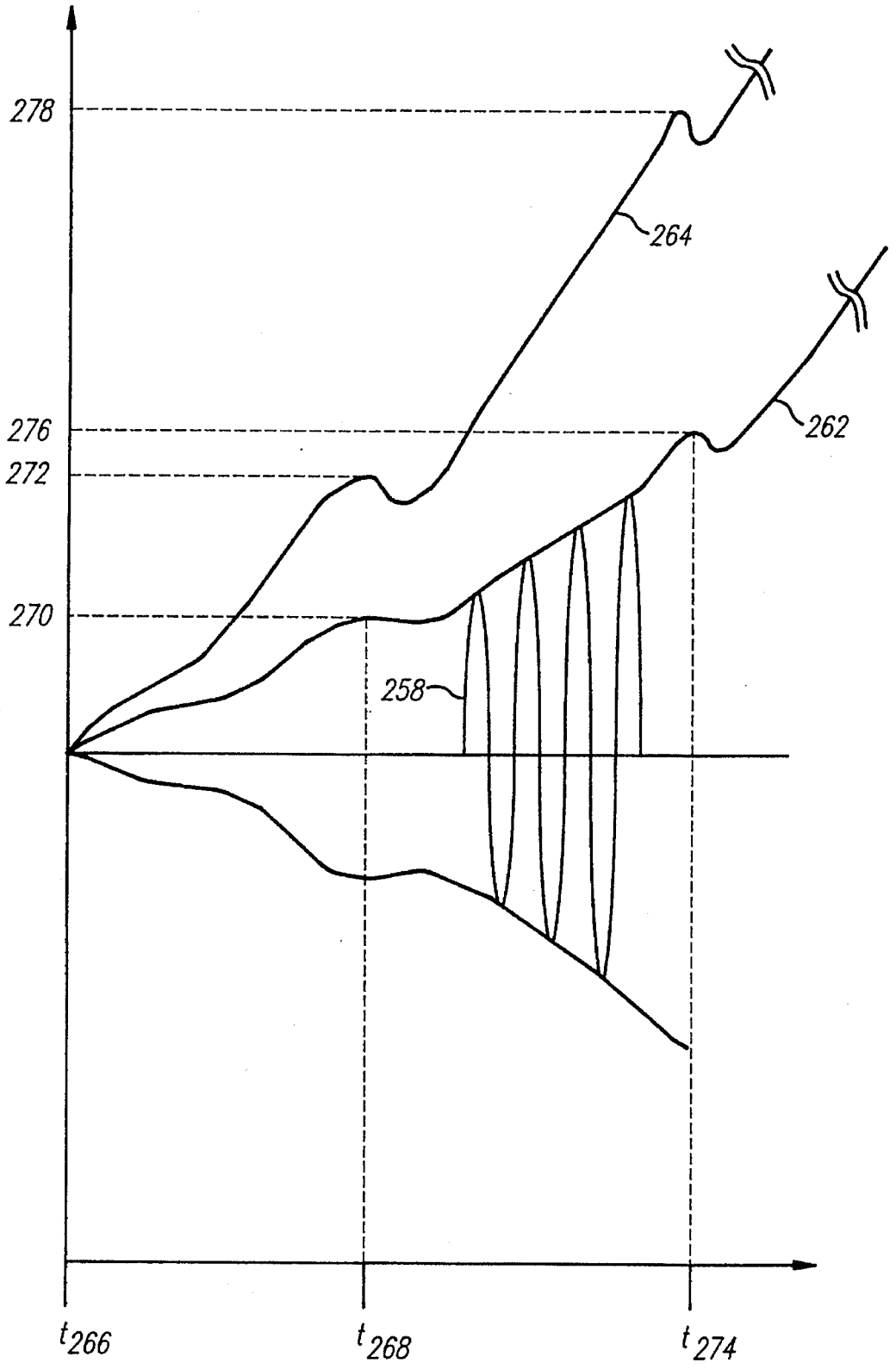
FIG. 14 is a graphical illustration of the AM detected envelopes of audio output signals from a range of commercially available CD players illustrating peaks or levels that may be selected as a unique timing mark near the beginning of many pre-recorded performances for synchronization purposes.

Referring therefore to FIG. 14, mass media input 12*a* consists of, or at least includes, audio input 258 representing the audio portions of pre-recorded performance 18. Only a small portion of audio input 258 is actually shown in FIG. 14 directly, for convenience. Audio input 258 is applied to level comparator 260 in unmodified media subsystem 252. In a preferred embodiment, level comparator 260 operates upon the detected envelope of audio input 258 rather than upon the audio frequency signal of audio input 258. Conventional AM radio receivers incorporate AM or envelope detectors which detect lower frequency signals modulated upon higher frequency carriers. The same principle may easily be applied to detect the more slowly changing envelope of the audio signal being processed.

As illustrated in FIG. 14, slowly changing AM signal 262 represents the envelope of more quickly changing audio input 258. The actual magnitude of the amplitude of envelope 262 varies as a function of time in accordance with the music being played within pre-recorded performance 18. In addition, the absolute magnitude of envelope 262 depends upon the characteristics of the particular CD player 55*a* being used. It has been discovered by a survey of currently commercially available player devices that the absolute magnitudes of their audio outputs may vary by as much as a factor of 2. That is, for any particular note within pre-recorded performance 18, the audio signal output level for that note from one commercial unit may be as much as twice the audio signal output level for the same note from a different commercial unit.

For convenience, envelope 262 is used to represent the detectable envelope of audio input 258 when played on a typical, low audio output level CD player 55*a* while envelope 264 is used to represent the detectable audio output level from audio input 258 when played on a typical, high audio output level CD player 55*a*. The expected range of variations in audio output levels will therefore be considered to be within this two to one range, but it is well within the skill of the art to adjust the techniques described for use with a different range of variation.

As shown in FIG. 14, at some beginning time, shown as time t266, within pre-recorded performance 18 the amplitude of envelope 262 and envelope 264 are both zero. That is, not counting noise or hiss, audio input 258 may be considered to zero at some beginning time for both high and low output level players. In accordance with the music included within pre-recorded performance 18, at some later time t268 an identifiable amplitude peak may be reached. At this time t268, amplitude 270 of envelope 262 would one half of amplitude 272 of envelope 264. Since envelopes 262 and 264 represent the outputs of the typical lowest and highest audio output players expected to be encountered, most if not all CD players 55*a* will produce outputs within the range between amplitudes 270 and 272 at time t268.

Although from FIG. 14, time t268 appears to be an acceptable level for use in determining the timing for enable pulse 254, it will be assumed that time t268 is not an acceptable time in order to illustrate what is required for an acceptable time for the timing mark to trigger enable pulse 254. At a time t274, later than time t268, another peak or level is reached. Amplitude 276 represents the magnitude of this envelope amplitude for envelope 262 type low output players while amplitude 278 represents the magnitude of this envelope amplitude for envelope 264 type high output level players. The range of expected amplitude levels from commercial available CD players 55*a* is therefore within the range of the amplitudes from amplitude 276 to amplitude 278.

Time t274 is a good candidate for use in triggering enable pulse 254 if the amplitude level from a low output audio player, represented by envelope 262, is substantially and distinguishably higher at this time than the highest preceding amplitude level from a high output audio player represented by envelope 264. That is, for the graphical representation shown in FIG. 14, time 274 would be an acceptable trigger level for generation of enable pulse 254 because amplitude 276, the lowest expected amplitude at time t274 is substantially greater than amplitude 272, the highest expected previous amplitude.

The time selected as enable pulse trigger time t274 depends upon the audio content of pre-recorded performance 18 and may conveniently be selected by the studio musician during the encoding of the performance as described above with regard to FIG. 2. It is possible with some musical performances that start with a slowly rising amplitude that this technique may be not be usable with a clear guarantee of accuracy for all players. It is however, an important and useful technique for providing synchronization to pre-recorded and unmodified performances for the great majority of such performances.

The amplitude and time selected by the studio musician during encoding, or automatically in accordance with the same general procedure, may be stored within ROM pack 24 and provided to level comparator 260 via level set 280 developed by ROM pack interface 120 from specialized media input 14. Level set 280 would therefore conveniently include a data item related to amplitude 276 and any relevant gain or amplification settings as well as a <Time Stamp> data item representing time t274. Thereafter, when the envelope detected by level comparator 260 from the particular CD player 55*a* being used reached amplitude 276, enable pulse 254 would be generated by level comparator 260 to set the time count of counter 282 to time t274.

In addition to enable pulse 254, counter 282 receives the output of music time clock 284 as the input to be counted and provides an updated <Time Stamp> data item as clock counter output 286 as one input to time stamp comparator 288. The other input to time stamp comparator 288 is provided by mapping data time stamp 290 decoded by data RAM and decoder 292 from mapping data 256. In this manner, when mapping data 256 includes a <Time Stamp> data item indicating that specified mapping functions are to be accomplished at a specified relative time, such as mapping event 236, that <Time Stamp> data item is decoded from mapping data 256 and applied to time stamp comparator 288 so that mapping event 236 can be caused to occur when clock counter output 286 reaches the same time value.

In other words, the mapping data includes time stamps indicating when a mapping event should occur relative to a predetermined time, detectable as a level or peak in the audio envelope. When the predetermined time is detected, the clock counter is started. When the counter reaches the same value as the data time stamp, time stamp comparator 288 produces timing data 291 to control the operation of serial data device 294. The other input to serial data device 294 is map data 296 which has been decoded and/or stored by data RAM and decoder 292 from mapping data 256 provided by ROM pack 24. Serial data device 294 thereafter provides a serial data stream of mapping data, synchronized to the performance being played on CD player 55*a*. The output of music data line 100 from serial data device 294 resulting from the playing of an audio or unmodified CD, associated with an appropriate ROM pack, is therefore the equivalent of music data line 100 produced by serial data device 226 from the playing of a CD ROM including inherently synchronized mapping data.

In a preferred embodiment, the operations of data RAM and decoder 292 may be provided directed by ROM pack 24 and ROM pack interface 120 but it is more convenient, for the purposes of the following descriptions of alternate mapping data sources, to illustrate data RAM and decoder 292 as a memory device separate from ROM pack 24 and its interface.

Figure 15:
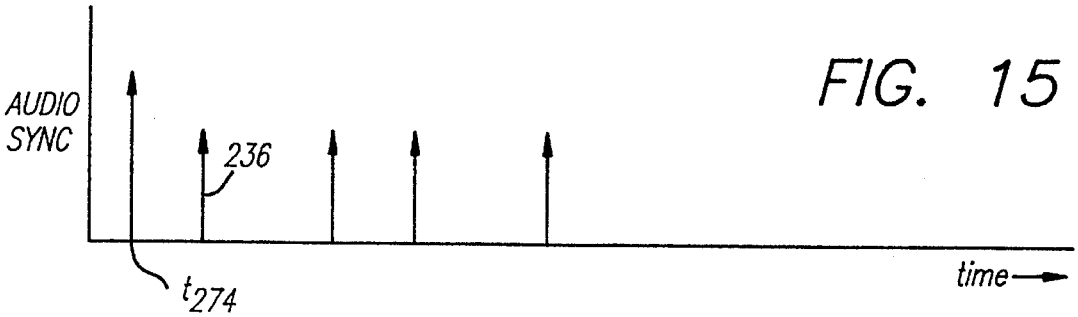
FIG. 15 is a timing diagram, using the same time basis used in FIGS. 12 and 13, illustrating the relationship of the uniquely selected timing mark and the subsequent musical events.

Referring now to FIG. 15, the operation of the above described synchronization technique may summarized as follows. During the encoding of note assisted mapping data onto ROM pack 24 for use with a particular pre-recorded performance 18, the studio musician selects time t274, shown in FIG. 14, as an appropriate timing reference at or near the beginning of pre-recorded performance 18 because the level or amplitude at time t274 may be detected even though individual CD players produce audio within a varying range of levels. The gain and amplitude levels necessary for the detection of time t274 are then stored in ROM pack 24 by the studio musician. In use, this data is used by level comparator 260 to detect the occurrence of time t274 during the actual pre-recorded performance 18 to enable counter 282 which then counts in response to the output of music time clock 284. When the <Time Stamp> data item within mapping data time stamp 290, representing a desired mapping event such as mapping event 236, is determined by time stamp comparator 288 to properly corresponding with clock counter output 286, music data line 100 is caused to include the relevant data items.

The accuracy of typical CD players 55*a* is extremely high so that after the initial synchronizing event, such as the detection of time t274, the accuracy of the counting by counter 282 should be sufficient to maintain synchronization between the mapping data and the performance for the duration of pre-recorded performance 18. Under some circumstances, described below, it may be desirable to provide more synchronization than the detection of a single, initial synchronizing event, such as a series of synchronizing, or resynchronizing, signals at fixed intervals. In addition, some sources of pre-recorded performance 18 may be modifiable to include mapping data that cannot be inherently synchronized with the performance as is achieved by, for example, the VBI encoding techniques described above with regard to the CD ROM played in VCR/CD ROM player 55.

Still referring to FIG. 11, one convenient example of a note assisted data input source which displays both resynchronization and an unsynchronized mapping data transfer is illustrated as CD-i player 298 which may be a commercially available conventional interactive CD player such as the devices sold by Phillips. The CD played in CD-i player 298 may be a fully modified CD in which mapping data is encoded on the media in an inherently synchronized manner such as by encoding the VBI intervals as discussed above with respect to the operation of VCR/CD ROM player 55. Alternately, the media played on CD-i player 298 may be fully unmodified, carrying no mapping data or added synchronization information in which case ROM pack 24 and its associated information and techniques may be required to provide both mapping data and synchronization information.

For the purposes of the following explanation, it will be assumed that the data format and capacity of the media to be played by CD-i player 298 permits the addition of sufficient data to provide the transfer of mapping data for pre-recorded performance 18 but only in a non-synchronized manner. For example, the data may be transferred in a block at the beginning of the playing time. Further, it will be assumed that a limited amount of synchronization data may be included within pre-recorded performance 18 as played on CD-i player 298, such as a timing mark each second. These assumptions presently appear to reasonably accurately reflect what can be provided without substantial modification to the currently preferred format or formats available for some classes of media, such as the commercially available Philip's interactive video system.

Figure 16:
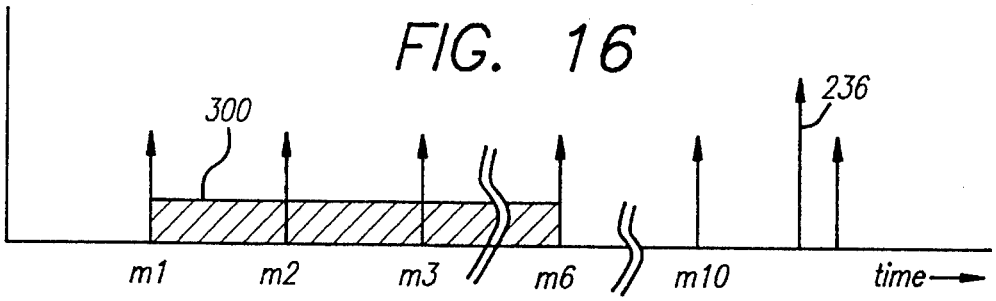
FIG. 16 is a timing diagram illustrating an alternate synchronization technique in which the mapping data is first provided in a preliminary data dump followed by a series of timing marks at predetermined intervals which may subsequently be used for maintaining synchronization between the mapping data and the pre-recorded performance.

Referring now also to FIG. 16, CD-i player 298 plays a media disk that has been encoded, in the manner described for example with regard to FIG. 1, to include timing marks at regular intervals throughout pre-recorded performance 18 such at ml through m5000 as well as a block of mapping data shown in FIG. 16 as mapping data dump 300. As illustrated in FIG. 16, mapping data dump 300 may conveniently occur at the beginning of pre-recorded performance 18 such as during the interval from, for example, timing marks m1 through m5. Both mapping data dump 300 as well as the timing marks are provided to keyboard/strummer 10 as mapping data 256, the portion of which including the timing marks is applied to time mark detector 302 as timing marks 304. Time mark detector 302 may simply be a hardware or software mechanism for developing or decoding <Reissuance Time Stamp> data items from time marks within mapping data 256.

<Resync Time Stamp> data items are applied to counter 282 via resync lines 306 from time mark detector 302 to maintain clock counter output 286 accurately synchronized with pre-recorded performance 18. It is important to note that this technique provides additional accuracy, if required, from that available by means of level comparator 260 which provides only an initial timing mark. The <Resync Time Stamp> data items on resync lines 306 may be used to both initialize as well as resynchronize clock counter output 286 throughout pre-recorded performance 18.

Mapping data dump 300 is provided as mapping data 256, at the beginning of pre-recorded performance 18, and stored in data RAM and decoder 292 so that music data line 100 may include the appropriate data items at the proper times. In particular, each occurrence of mapping data time stamp 290 may be related to a specific item of map data 296, both of which are stored in data RAM and decoder 292 as a result of the initial mapping data dump 300. When the proper correlation between mapping data time stamp 290 and clock counter output 286 is detected by time stamp comparator 288, timing data 291 is applied to serial data device 294 to produce the appropriate packet of mapping data at the appropriate time synchronized with pre-recorded performance 18 by including that data packet in music data line 100.

Figure 17:
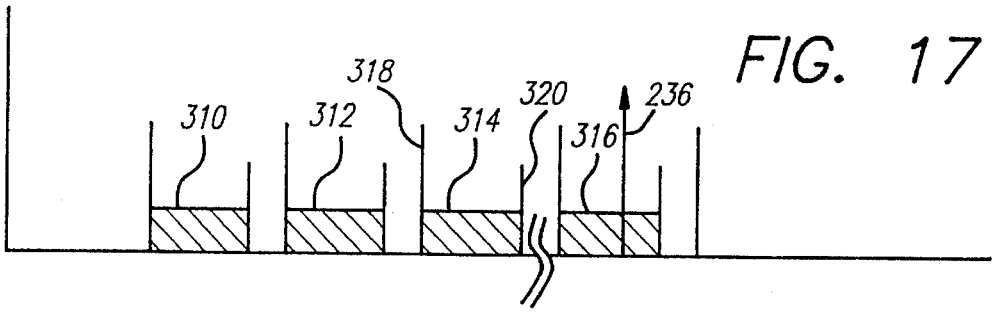
FIG. 17 is a timing diagram illustrating a further alternate synchronization technique in which the mapping data is transferred in discrete chunks of data, the timing of which provides the required synchronization and/or resynchronization timing marks.

Referring now to FIGS. 11 and 17, an alternate approach may be preferred for use with media formats that provide the capacity to transfer more than timing marks at regular ongoing intervals during pre-recorded performance 18. CD-x player 308 of FIG. 11 is used to illustrate this approach in which at least some mapping data may be transferred at regular intervals. As shown in FIG. 17, a series of timed data dumps, such as partial data dumps 310, 312, 314 and 316, provide the advantage of transferring mapping data with inherent data time marks. That is, referring specifically to partial data dump 314 as an example, leading edge 318 or trailing edge 320 of partial data dump 314 may conveniently serve as the equivalent of a timing mark to maintain synchronization between pre-recorded performance 18 and the mapping data utilized by keyboard/strummer 10. For example, the mapping data in partial data dump 314 applied by CD-x player 308 to data RAM and decoder 292 may contain data item related to mapping event 236 desired to occur at a later time. Mapping data time stamp 290 and map data 296 related to mapping event 236 would be stored in and decoded by data RAM and decoder 292 and applied to time stamp comparator 288 and serial data device 294 respectively so that the appropriate data items related to mapping event 236 would appear in music data line 100 at the appropriate predetermined time. Data mark detector 322, responsive to a series of recurring timing marks such as leading edge 318 or trailing edge 320 of each partial data dump, thereby produces resync line 306 applied to counter 282 to maintain the clock in keyboard/strummer 10 in synchronization with the timing of pre-recorded performance 18.

With regard to all types of media sources of pre-recorded performance 18 and note assisted mapping data, it may be desirable to intentionally vary the internal timing of keyboard/strummer 10 under certain circumstances even though it is important to maintain an overall synchronization between the mapping data and pre-recorded performance 18. For example, it may be convenient to vary the tempo of the mapping and performance data being provided to keyboard/strummer 10. In a preferred embodiment, for example, it may convenient to provide repetitive musical information in the form of mapping events whose time scale may be changed at different times during the playing of keyboard/strummer 10. For a simple example, a particular series of drum notes may be described in a data item in the nature of a programming macro as a series of drum sounds separated by an appropriate predetermined series of predetermined relative time delays. Rather than prepare different drum note sequences having a different time scale for each similar set of drum sounds, a slow drum sequence could be used for both slow and fast drum sounds by changing the tempo.

To accomplish variable tempo for performance and/or mapping data, the rate at which clocking outputs from music time clock 284 may be under software or data item control. That is, for a standard, unmodified timing, music time clock 284 may provide a clock pulse in exact response to a fixed clock having relatively high accuracy such as a crystal clock shown in FIG. 11 as 1 Khz fixed clock 324. This may occur as a default operation of music time clock 284 or be controlled by a specific data item referred to herein as the <TEMPO> data item.

The unmodified 1 Khz clock rate may conveniently be represented by a <TEMPO> data item, stored and or decoded from mapping data 256 by data RAM and decoder 292, representing a tempo of 100%. A subsequent <TEMPO> data item representing 50% of clock would result in a tempo half as fast as the standard tempo and would then be applied to music time clock 284 via tempo line 326 causing music time clock 284, and therefore counter 282, to operate at half the speed. This operation would present the relevant <Time Stamp> clock counter output 286 to time stamp comparator 288 for comparison against mapping data time stamp 290 at a later time, producing timing data 291 at a later time.

Although a two to one range of tempo rate changes has been described in this example, most practical applications of tempo changes would result in much smaller percentage changes such as a 10 or 20% change in either direction, that is, faster or slower than the standard tempo. The <TEMPO> data items may conveniently be created by the studio musician during the encoding of the performance, as shown for example in FIG. 1, as part of drum track 26 or as a separate item if desired and may conveniently be used to provide the metronomic or tap tempo beat of the performance.

Figure 18:
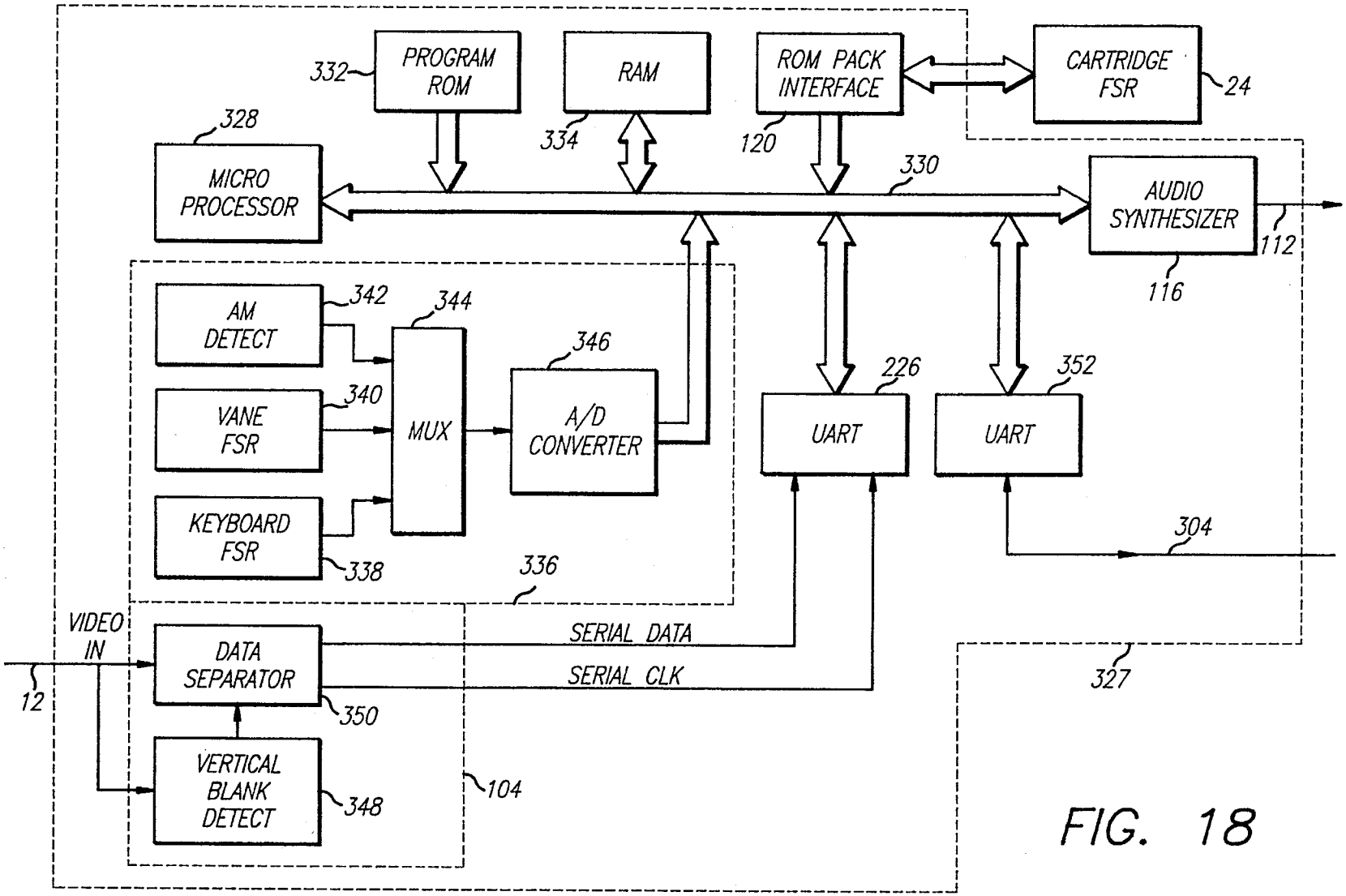
FIG. 18 is a schematic block diagram of a preferred implementation of the present invention in a programmed microprocessor environment.

Referring now to FIG. 18, the presently preferred implementation of at least the music controller portion of keyboard/strummer 10, shown as music controller 102 in FIG. 3, music controller **102*a* in FIG. 9, and music controller portion 102*b* in FIG. 11, is in programmed microprocessor environment 327 which is advantageously fully contained within keyboard/strummer 10. In particular, microprocessor 328, which may conveniently be a conventional Z80 processor, is interconnected by bus 330 with program ROM 332, containing the bulk of the software implementing the present invention, and RAM 334** which is used as the main working memory.

It is important to note that although on a transitory basis RAM 334 may include mapping data during a conversion or synchronization operation, the bulk of the mapping and synchronization data is not maintained within programmed microprocessor environment 327. Mapping data, that is note assisted music data input, is applied to programmed microprocessor environment 327 by the media including pre-recorded performance 18, such as the CD, music video or other mass media format and/or ROM pack 24 which may be interconnected with programmed microprocessor environment 327 by insertion into ROM pack interface 120 of keyboard/strummer 10.

In addition to interconnecting the various forms of memory with microprocessor 328, bus 330 is tied directly to audio synthesizer 116 under the control of microprocessor 328 in response to the various inputs applied to programmed microprocessor environment 327. For example, the application of key and vane actuation information illustrated in FIG. 3 as applied to instrument microprocessor 108 via keyboard decoder 110 is implemented in the currently preferred embodiment in analog to digital subsystem 336, as follows.

Activation of keys within keyboard section 36, and vanes within strummer 38, changes the forces applied to the FSRs in contact therewith as discussed above with regard, for example, to FIGS. 4–7. These FSRs produce analog signals in response to the forces applied thereto and are represented within programmed microprocessor environment 327 as keyboard FSRs 338 and vane FSRs 340. The analog signals produced thereby must be converted to digital form for application to bus 330 for use, for example, by microprocessor 328. In particular, a convenient implementation of level comparator 260 shown in FIG. 11, may include an amplitude modulation or AM detector, such as AM detector 342, for producing an analog signal representing the envelope of the audio input. The remainder of the operations that must be performed to produce enable pulse 254 by level comparator 260 may be carried out more efficiently in the digital domain by microprocessor 328 with reference to data stored in ROM pack 24 (and/or read into RAM 334) once the output of AM detector 342 has been digitized.

Although each such analog signal may be separately digitized, it is more efficient with the amount of data to be processed and the speed of processing available, to apply the analog signals produced by keyboard FSRs 338, vane FSRs 340 and/or AM detector 342 to analog multiplexer 344. The output of analog multiplexer 344 is a selected one of such analog signals input thereto so that a single analog to digital converter such as A/D converter 346 may be used to digitize the applied analog signal. The digitized output of A/D converter 346 is then applied to bus 330.

Video signals, such as mass media input 12 from VCR/CD ROM player 55 shown in FIG. 11, are applied to a dedicated video processing subsection such as VBI data decoder 104 to produce mapping data 222 and timing data 224. In the preferred implementation shown in programmed microprocessor environment 327 of FIG. 18, VBI data decoder 104 includes vertical blanking interval or VBI detector 348 which synchronizes VBI encoded data separator 350 to the VBI frames within mass media input 12 so that the data encoded therein may be decoded and provided as mapping data 222 and timing data 224. The outputs of VBI data decoder 104 are applied to a conventional serial data input/output device such as serial data device or UART 226 to applying music data line 100 to bus 330 in a format convenient for use by devices connected to bus 330, especially microprocessor 328.

Data in digital format, such as timing marks 304 provided in the output of CD-i player 298 as shown in FIG. 11, may be applied to bus 330 from other sources, such as an RS-232 port on CD-i player 298, via additional I/O devices such as UART 352. The remaining operations shown in music controller 102 of FIG. 3 and music controller portion **102*b* of FIG. 11 may be implemented in a conventional manner by microprocessor 328 under the programming control of the programming data stored within program ROM 332. It is well within the skill of a person of ordinary skill in these arts to prepare the appropriate programming data for storage within program ROM 332** to provide the functions described herein.

In this manner, great flexibility is provided for the use of keyboard/strummer 10 with new performance and new media types as they become available by changing the data applied by the medium used and, if necessary, by simply upgrading program ROM 332 to revise the programming data stored therein. Even more importantly, the undesirable mechanical music feelings aroused by music from canned music sources, or computer generated music sources, has been overcome by the present invention. A substantial advantage of the present invention is that music resulting from playing of keyboard/strummer 10 is real music, including the human advantages and disadvantages of the skill and creativity of the musician playing keyboard/strummer 10, as well as the studio musician who encoded the note assisted music data input for that performance. The use of computer generated music controlled by computer generated data or data retrieved from look-up tables with the computer environment is replaced with music produced by the human musician playing keyboard/strummer 10 which has been aided by the use of computer encoded and decoded data prepared by another musician, the studio musician, to assist but not limit the playing musician.

During operation with ROM pack 24, it may be more convenient and efficient from a computational basis to leave the mapping data within ROM pack 24 rather than transfer the data into RAM 334 which even further emphasizes that programmed microprocessor environment 327 is used to process the song by song mapping data made available to programmed microprocessor environment 327 from each media input device containing pre-recorded performance 18. The desirable flexibility of this configuration is easily illustrated with regard to operation with ROM pack 24 which contains, in effect, the studio musician's rendition of pre-recorded performance 18.

For each pre-recorded performance 18, musical note assist data input includes sufficient data to reproduce the studio musician's rendition of the performance as well as other data for tempo, etc. The data sufficient to reproduce the studio musician's rendition may be considered performance data, that is, data suitable to reproduce the musical performance. The mapping data may therefore be considered primarily a subset of the performance data. In particular, the playing musician playing keyboard/strummer 10 may chose to utilize all the performance data for a particular piece of music encoded within ROM pack 24 so that the audio output of keyboard/strummer 10 is the studio musician's rendition of pre-recorded performance 18. During the playing of the studio musician's version, the playing musician need not activate any portion of keyboard/strummer 10 and will hear one interpretation of pre-recorded performance 18. At this level of play, there is no contribution by the playing musician so there is no opportunity for creative input or improvement.

In a more creative mode, keyboard/strummer 10 may be configured to produce music from the performance data by strumming strummer 38 of keyboard/strummer 10 which are programmed with sufficient performance data to reproduce the studio musician's version of pre-recorded performance 18. In this mode, the playing musician provides some creative input to the music being produced by the timing, duration and manner in which the vanes are strummed. In another mode, the chords of pre-recorded performance 18 may be mapped to some of the vanes of strummer 38 while other vanes are available for other uses. In particular, in a six vane arrangement, it is especially convenient and useful to map the chords of pre-recorded performance 18 to the center four vanes while mapping the melody line to the upper first vane and the base line to the lower or bottom vane.

In this and similar modes in which the chords are mapped to a subset of the vanes available within strummer 38, the remaining vanes may be played by the playing musician at will. Whenever the melody or base line seems appropriate, it may be added. In one such mode, for example, the playing musician may choose to not play the mapped chords and play only the melody and base lines, with or without keyboard accompaniment and/or some combination thereof. Many such combinations of fully or partially mapped data may be combined with performance data so that the playing musician may choose the level of note assisted data input to be used for a particular session. It is expected that the playing musician may start with sessions in which primarily performance data is used as the playing musician learns the piece. The playing musician may then gradually expand his or her input as it seems appropriate and/or gradually reduce the performance data being used to produce music while adding variations and creative changes by playing keyboard section 36 and strummer 38 of keyboard/strummer 10.

Figure 19:
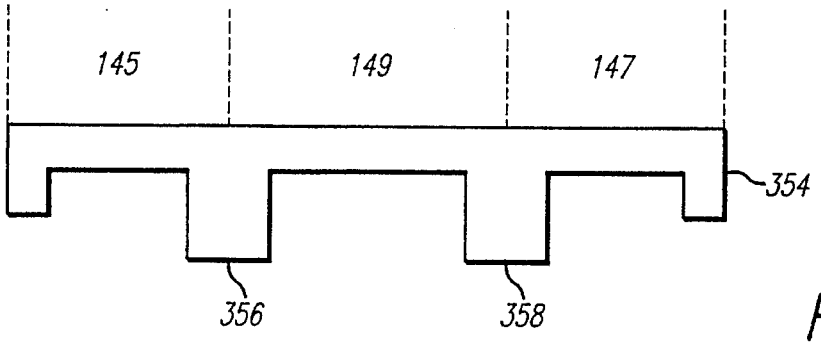
FIG. 19 is a cross sectional view of an alternate preferred embodiment of the key cap shown in FIG. 5.
Figure 20:
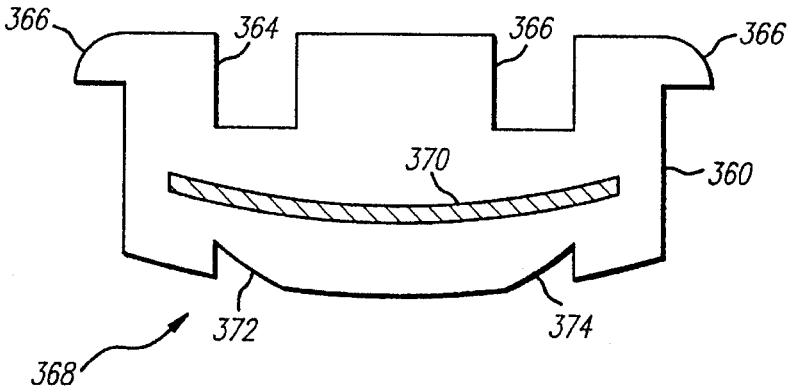
FIG. 20 is a cross sectional view of a preferred embodiment of a force spreading pad for use with the key cap shown in FIG. 19.
Figure 21:
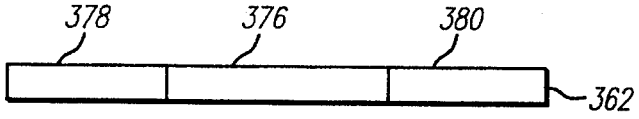
FIG. 21 is a cross sectional view of a preferred embodiment of a multi element FSR for use with the key cap and force spreading pad of FIGS. 19 and 20.
Figure 22:
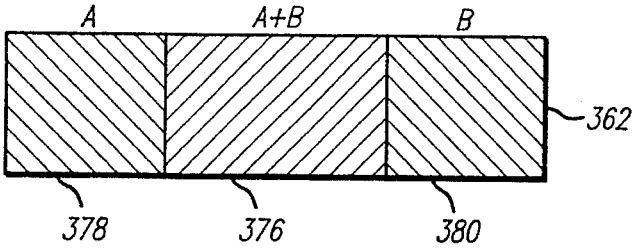
FIG. 22 is a plan view of the multi-element FSR shown in FIG. 21.

Referring to FIGS. 19 through 22, FIGS. 19 through 21 shown an exploded cross-sectional view of an alternate preferred embodiment of the key input assembly 128 shown in FIG. 5. FIG. 22 is a top plan view of multi-element FSR 362 shown in cross-sectional view in FIG. 21. In particular, FIG. 19 is a cross-sectional view of key cap 354 including outboard area 145, sweetspot 149 and outboard area 147 outlined generally in the same manner as shown on key cap 148 of FIG. 5. The relative sizes of outboard areas 145 and 147 with respect to sweetspot 149 have been exaggerated for convenience of the following explanation. Key cap 354 is made of a convenient rigid plastic, of the type conventionally used for similar key caps, and includes posts 356 and 358 or similar suitable means for attachment to a force spreading pad in the form of reinforced rubber rocker 360 shown in FIG. 20. Reinforced rubber rocker 360 is mounted in contact with multi-element FSR 362 shown in cross-sectional view in FIG. 21. Reinforced rubber rocker 360 includes post engagement holes 364 and 366 into which posts 356 and 358 are inserted when key cap 354 is assembled with reinforced rubber rocker 360 and multi-element FSR 362. Reinforced rubber rocker 360 may also include other elements for securing the proper relationship with key cap 354 such as bumps 366 which fit inside suitable apertures within key cap 354.

A major feature of reinforced rubber rocker 360 is rocker radius 368 indicated generally at the lower surface of reinforced rubber rocker 360 which contacts multi-element FSR 362. The radius of the lower surface of reinforced rubber rocker 360 is relatively large compared to its length so that, for example, for a keycap on the order of 2 inches long, the radius of rocker radius 368 may therefore be on the order of 20 inches. This provides a suitably smooth, rounded surface for transferring forces applied to key cap 354 evenly to multi-element FSR 362 for the detection of both the forces applied thereto as well as the position of the application along key cap 354 of such forces. In order to more accurately and consistently provide a clear separation for the detection of forces applied to outboard areas 145 and 147 from those applied to sweetspot 1.49, and to provide some tactile feedback to the musician, reinforced rubber rocker 360 includes rocker radius reinforcement 370 and sweetspot gaps 372 and 374.

Rocker radius reinforcement 370 may conveniently be fabricated from a thin, preformed strip of spring steel or other suitable, relatively rigid material caused to have a radius on the order of the radius of rocker radius 368 and positioned within reinforced rubber rocker 360 generally in parallel with rocker radius 368. Rocker radius reinforcement 370 causes rocker radius 368 at the bottom surface of reinforced rubber rocker 360 to generally maintain its rounded shape when forces are applied thereto by the playing musician even when the point of application of the force is moved across the keycap when for example the musician slides his finger from one outboard area through the sweetspot to the other outboard area. The forces applied to key cap 354 are transferred to multi-element FSR 362 by reinforced rubber rocker 360 so that pressure applied to sweetspot 149 is consistently applied to central sweetspot FSR 376 while forces applied to outboard areas 145 and 147 are consistently applied to outboard FSRs 378 and 380, respectively.

Sweetspot gaps 372 and 374 are gaps or reliefs removed from rocker radius 368 to provide clarity and separation between forces applied at the edges of sweetspot 149 and one of the outboard areas 145 and 147. In particular, forces applied to sweetspot 149 near outboard area 145 on key cap 354 are clearly applied to central sweetspot FSR 376 until the position of the force has been moved from sweetspot 149 far enough toward the left of the figure to clearly have been moved to outboard area 145. Sweetspot gap 374 similarly serves to separate forces as they are applied to the border between sweetspot 149 and outboard area 147.

Referring now to FIG. 22, a top plan view of multi-element FSR 362 is shown, more clearly identifying central sweetspot FSR 376 and outboard FSRs 378 and 380. As discussed above with regard to FIG. 5, the multi-element FSRs may conveniently be configured from a pair of FSRs a portion of which are interrelated or intertwined. For example, if pressure applied to outboard FSR 378 produces a signal designated as "A", and pressure applied to outboard FSR 380 produces a signal designated as "B", then the signal produced by central sweetspot FSR 376 may actually be a combination of the "A" and "B" signals, i.e. an "A +B" signal. As noted above with regard to FIG. 5, the relative amplitudes of the "A" and "B" components of "A+B" signal may conveniently indicate the position along sweetspot 149 at which the force is applied. Central sweetspot FSR 376 may therefore be formed from a pattern combining outboard FSRs 378 and 380 together.

Figure 23:
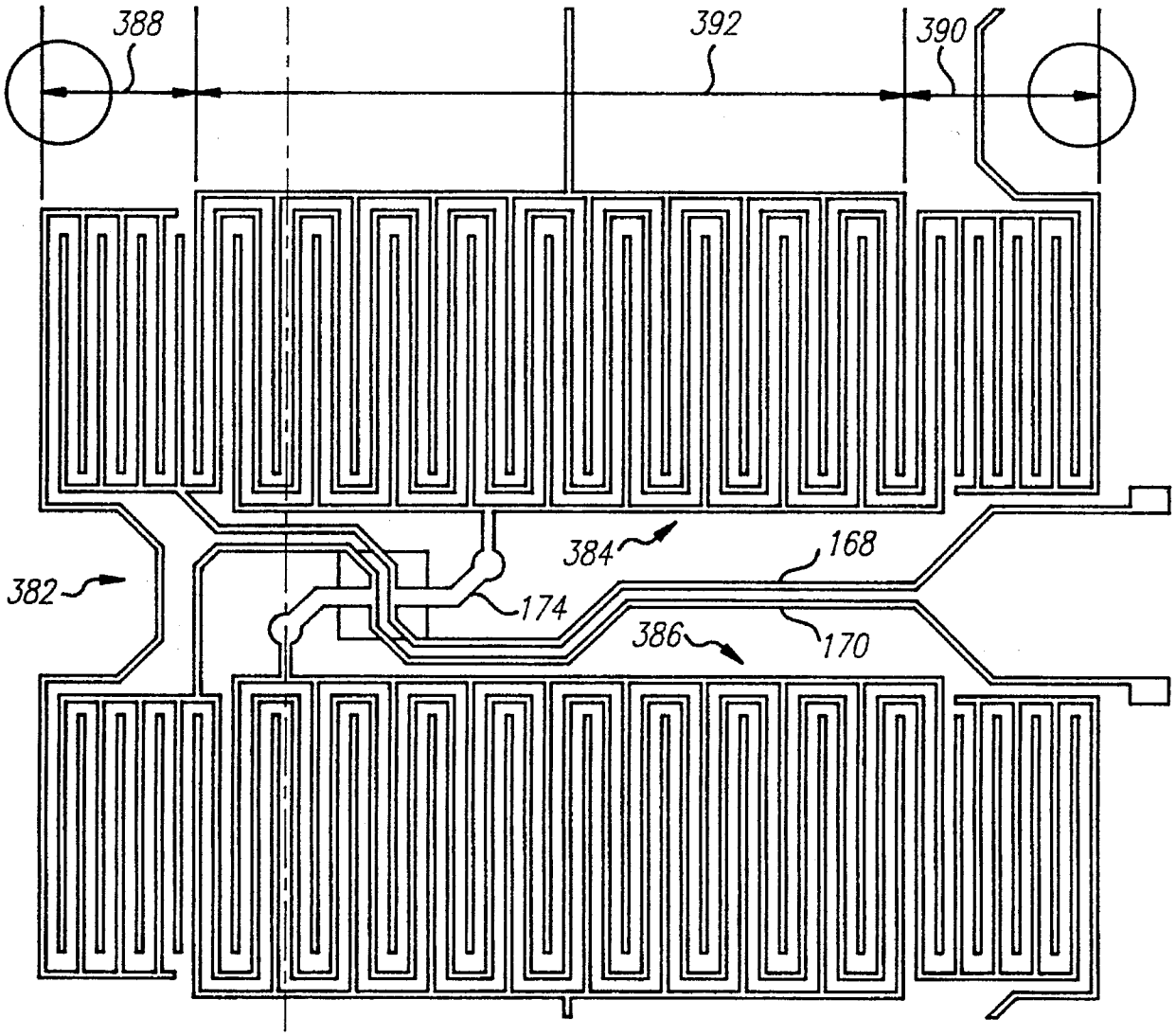
FIG. 23 is a top plan view of a presently preferred patterned FSR pair layout of a pair of the multi-element FSRs shown in FIGS. 21 and 22.

FIG. 23 is a top plan view of patterned FSR pair layout 382 for a pair of adjacent multi-element FSRs 362 as shown in FIGS. 21 and 22. Patterned FSR layout 382 is the presently preferred alternate embodiment of stepped FSR layout 166, shown in FIG. 8, for use as a pair of multi-element FSRs 362 with the assembly of a pair of key caps 354 and reinforced rubber rockers 360, one each of which is shown in FIGS. 19 and 20, respectively. In a preferred embodiment of keyboard section 36, shown for example in FIG. 1, there are twenty two keys so that three full octaves plus an additional note may be available at any one time. The twenty two keys may conveniently be provided with FSRs constructed in subsets of eleven sets of FSR patterns, two of which are depicted in FIG. 23.

As shown in FIG. 23, patterned FSR pair layout 382 includes upper patterned FSR layout 384 and identical lower patterned FSR layout 386. Each such patterned FSR layout includes read line 174 as well as "A" bus trace 168 and "B" bus trace 170 which are connected to a sensor driver/detector such as sensor driver/detector 172 shown in FIG. 8. The patterns of the traces and read lines provide outboard FSR 378 shown for example in trace area 388 of upper patterned FSR layout 384, outboard FSR 380 in trace area 390 and central sweetspot FSR 376 in central trace area 392.

Referring now again to FIG. 11, various alternate techniques may be used for determining synchronization with conventional, unmodified media that do not conveniently provide a timing mark for use with mass media input 12*a* or specialized media input 14. In accordance with the present invention, however, a timing mark may be selected for each pre-recorded performance 18 and/or song within each such performance, as described below.

Figure 24:
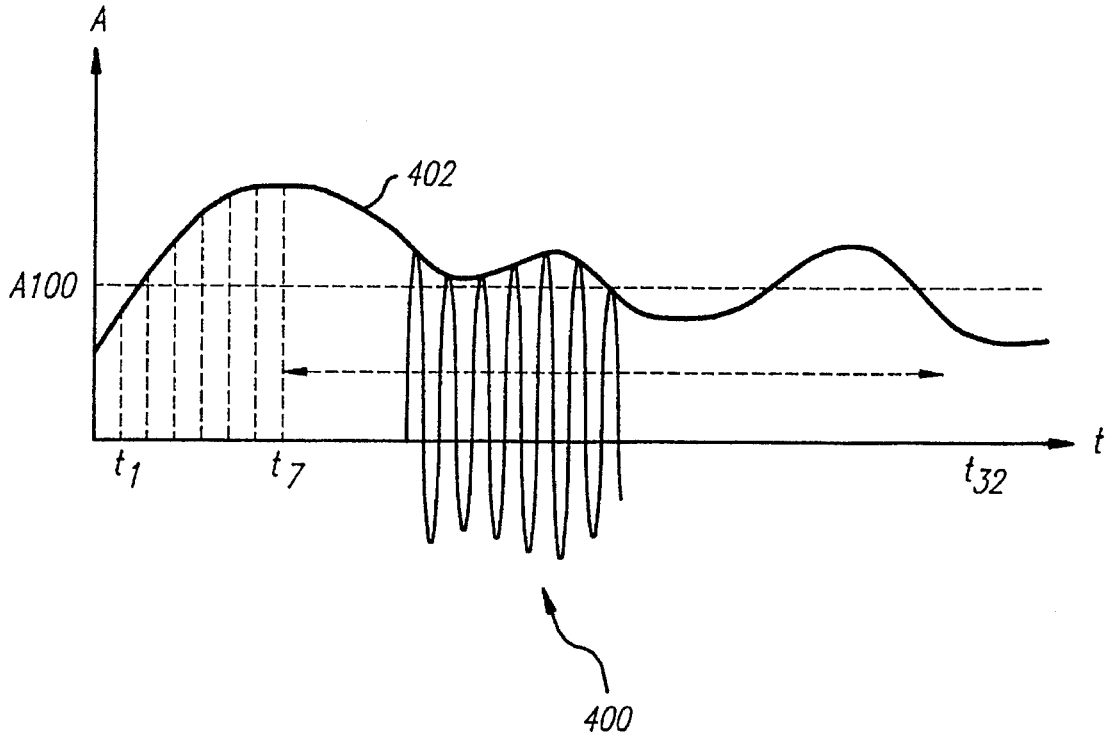
FIG. 24 is a graphical illustration of an audio performance waveform depicting another alternate technique for determining synchronization with music on a CD.

Referring now also to FIG. 24, a computationally efficient curve fitting technique may be used for determining synchronization with unmodified conventional media, such as CD's. A digitized envelope of the audio input from the unmodified media is compared to a normalized version of the beginning portion of the performance which has already been stored in ROM. In particular, mass media input 12*a* includes audio input 400 representing the audio portions of pre-recorded performance 18. Only a small portion of audio input 400 is actually shown in FIG. 24 directly, for convenience. Using the same hardware configuration described above with regard to FIG. 18, audio input 400 is processed by analog to digital subsystem 336 under the control of microprocessor 328. The lower frequency envelope of audio input 400 is detected by AM detector 342 to reduce the computation overhead that would otherwise be required to process the audio frequency signal of audio input 400.

The output of AM detector 342 is slowly changing AM signal or audio envelope 402 which represents the envelope of more quickly changing audio input 400. The magnitude of the amplitude of envelope 402 varies as a function of time in accordance with the music being played within pre-recorded performance 18. In addition, the absolute magnitude of audio envelope 402 depends upon the characteristics of the particular CD player 55*a* being used. The audio outputs of commercially available player devices vary by as much as a factor of 2.

In order to detect a specified waveform by curve fitting, a digitized copy of the waveform to be detected is stored under the direction of the studio musician during the development of the note assist data. The details of the digitizing, sampling and storage of the master sampling interval from pre-recorded performance 18 will be described following the description immediately below of the digitizing and sampling of audio envelope 402 which is accomplished in the same manner.

The curve fitting techniques used in the present invention substantially reduce the computational overhead required. In conventional curve fitting applications, a sampling rate on the order of about 1000 samples per second would likely be required to digitize AM signal 402 with sufficient resolution to permit the use of curve fitting techniques to provide a timing mark for synchronizing with a CD. In accordance with the computational efficiencies of the present invention, a sampling rate of only 200 samples per second has been determined to provide sufficient resolution for this task.

It is important to note that reducing the sampling rate reduces the computational overhead required in accordance with the square root of the number of computations. In particular, reducing the sampling rate from 400 to 200 samples per second requires that only half the number of samples must be multiplied and these multiplications may be carried out in twice the amount of time required at a 400 sample per second rate.

It has been determined that 32 bytes of data, sampled at 200 samples per second, provides sufficient resolution to accurately synchronize a CD by curve fitting techniques. The number of bytes of data stored may easily be changed, but the computational overhead increases with the number of bytes used for curve fitting. In a conventional curve fitting application, each of the sampled bytes would have to be tested for each of many different amplitude levels to try to match the performance sample interval to the master sample interval. To reduce computational overhead by reducing the number of amplitudes levels, and therefore the number of multiplications required, the sampled data is first normalized.

In particular, as noted below, the average value of the 32 samples of each performance sample interval at the beginning of pre-recorded performance 18 is determined and normalized to an arbitrary value such as 100. The amplitude value of each sample is then adjusted to this normalized value.

Figure 25:
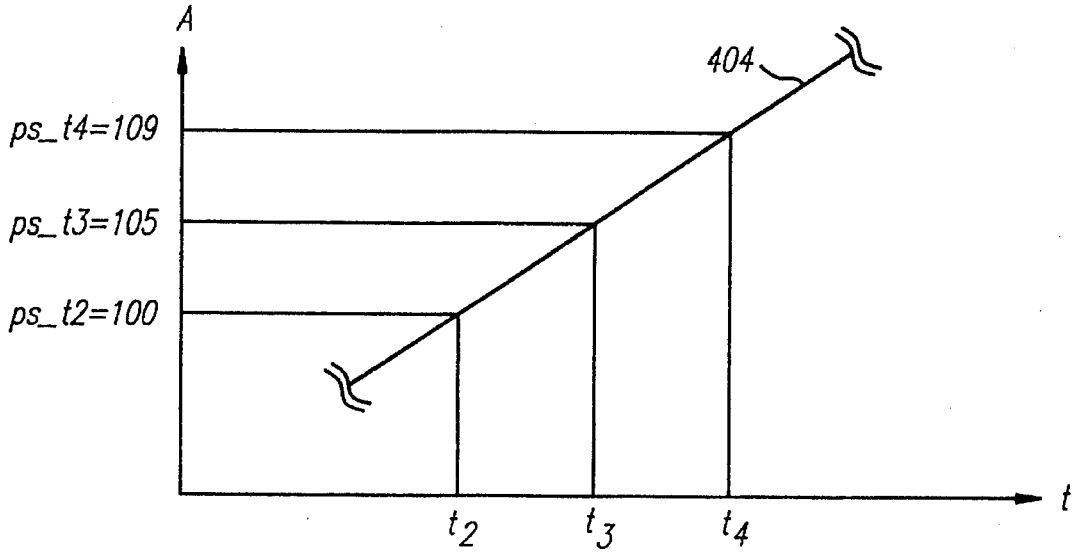
FIG. 25 is an expanded view of a portion of the audio performance waveform graph shown in FIG. 24 showing several performance samples.

As shown for example in FIG. 24, audio envelope 402 is sampled at times t1 through t32. The average value of the amplitudes sampled at these 32 times is computed and normalized to a value of 100 and the value of each sample is adjusted accordingly. Examples of three such samples, at times t2, t3 and t4, are shown in an enlarged view in FIG. 25 as ps_t1, ps_t2, and ps_t3, respectively, for audio envelope portion 404 of the performance then being played on CD player 55*a*.

At time t2, sample amplitude ps-t2 of audio envelope portion 404 happens for convenience to be at its average value, reset by normalization to a value of 100. At time t3, sample amplitude ps-t3 equals 105 while at time t4, ps-t4 happens to equal 109. The normalized amplitude values of audio envelope 402 for all such sample times, from t1 through t32, are determined by analog to digital subsystem 336 and applied to bus 330 for use by microprocessor 328 during a curve fitting routine to determine an appropriate timing mark for synchronizing the operations of keyboard/strummer 10 to a particular pre-recorded performance 18 from an unmodified media such as a CD.

Similarly, a master sampling interval—of a portion of the audio envelope of pre-recorded performance 18—has previously been developed and stored in ROM pack 24. Although any interval at the beginning of the music is theoretically useful as a starting point for curve fitting, it may be convenient for the studio musician to utilize conventional audio waveform analysis techniques to select a suitable interval in terms of its audio characteristics. The goal of such analysis is to verify that the selected interval is sufficiently unique, when compared to all preceding intervals, that inaccurate synchronizations will not occur.

One way to verify sufficient uniqueness of the selected master sample interval is to use the present invention to attempt to curve fit or shape match earlier samples of the master, as if they were performance samples, against the selected master sampling interval. For example, if the last 32 200ths (or 32 bytes) of the third second of pre-recorded performance 18 were selected as the master sampling intervals, all earlier 32 byte intervals would then be compared against the selected interval to determine if a match could be made. If the selected interval was badly chosen so that it was not unique, the pattern matching might indicate the problem by indicating a match to the wrong interval.

For even greater assurance of uniqueness, a minimum threshold of uniqueness may be determined or the relative uniqueness of several possible master sampling intervals may be determined by several rounds of comparisons. For example, if by visual inspection or other means three different intervals were chosen as candidates for the master interval, such as interval A, interval B and interval C, each such interval would be tested as a potential master interval in the studio by comparison with all previous intervals. A number would then be generated indicating the relative uniqueness of that interval.

Any of the intervals achieving the predetermined minimum threshold of uniqueness could be used, or the interval having the most relative uniqueness could be used. In accordance with the implementation of the present invention described below, the number representing the relative uniqueness of each such interval would be the sum of the squares of the errors for each bit sampled. The interval A, B or C having the lowest number would then be selected as the master sampling interval and then digitized and stored, for example, on ROM pack 24 for retrieval by microprocessor 328 via ROM pack interface 120.

In the same manner as described above with regard to performance samples, 32 master samples of the audio envelope of the rendition of pre-recorded performance 18 on the CD during the master sampling interval are digitized at a sampling rate of 200 samples per second, normalized to an average sample amplitude value of 100, and stored as a master sampling interval data ms_t1 through ms_t32 in ROM pack 24.

In order to synchronize keyboard/strummer 10 with a particular pre-recorded performance 18, performance sampling intervals of the performance played, for example, on a conventional player such as VCR/CD ROM player 55, CD player 55*a*, or CD-i player 298 all shown in FIG. 11 are compared with the master sampling interval stored for that performance in ROM pack 24. Although the comparison between master and performance sampling intervals to determine a timing mark by curve fitting may be accomplished by several conventional techniques, such as the least squares, sum of absolute errors, worst case and similar techniques, in a presently preferred embodiment, a computationally efficient for of the least squares technique is used.

A conventional least squares technique for curve fitting would sum the squares of the differences between the master and performance sample interval for each sample. When the sum of the squares of these differences was below a predetermined threshold, the error between the datum points in the performance and the master sampling intervals would be below an acceptable level. This would indicate that the curve fitting process was completed successfully. This technique is represented by the following equation:

$$(e_t1)^2+(_t2)^2+(e_t3)^2+\ldots+(e_t32)^2<A \quad (1)$$

where e_tn represents the difference or error determined at time tn, and A is the predetermined maximum error threshold below which an acceptable match is said to have been determined.

In a conventional least squares approach, the differences between the master and performance sampling interval are determined on a point by point basis so that the error for the performance sample taken at time tn is equal to the difference between the performance sample at tn and the master sample at tn. This is shown in the following equation in which ms_tn—ps_tn replaces e_tn:

$$(ms_t1 - ps_t1)^2 + (ms_t2 - ps_t2)^2 + \ldots + (ms_at32 - ps_t32)^2 < A \quad (2)$$

where ms_tn is the master sample amplitude at time n and ps_tn is the performance sample amplitude at time n.

In order to further reduce computational overhead, the relatively smooth changes of the audio envelope may be advantageously employed to reduce sampling phase error. Sampling phase error results from the fact that the relative timing of samples within the master and performance sampling intervals are uncoordinated or out of phase with each other. For example, if a peak of any particular audio envelope waveshape is used as a reference point for discussion, the sampling performed for the master sampling interval may occur anytime within one 200th of a second of that peak. The sampling for the performance sampling interval for an accurate curve fitting may also happen to occur anywhere within one 200th of that peak. The maximum sample timing or phase error between accurately fitted curves for that peak, and any other reference point, may therefore be two 200ths of a second for any particular sample.

In accordance with the present invention, a pre-processing technique to reduce sampling phase error is employed before the least squares computations are made. In particular, the performance sample for any particular time is compared to a window in the master sample including both that same sample time and also the next sample time in sequence. That is, ps_tn is compared to a window extending from ms_tn and ms_t(n+1).

In particular, the performance sample at t2 is compared to the master sample window extending from t2 to t3. When the amplitude of the performance sample is within that window, the error for that sample is set to zero as shown below.

$$(e_tn)^2=0 \text{ if } ms_tn \leqq ps_tn \leqq ms_t(n+1). \quad (3)$$

If the amplitude of the performance sample is not within the master sample window, the magnitude of the error for that sample is determined from the difference in amplitudes between the performance sample and the nearest of the two master sample window edges, $$\begin{aligned} &\text{if } ps_tn < ms_tn \text{ or } ps_tn > ms_t(n+1), \\ &(e_tn)^2 = (ms_tn - ps_tn)^2 \\ &\text{or} \\ &(ms_t(n+1) - ps_tn)^2, \text{ whichever is less.} \end{aligned} \quad (4)$$

As can be seen from an inspection of equation 3, even if the performance sample is a perfect match for the master sample, the performance sample for t2 is assumed to occur in the window in time between master samples at t2 and t3 due to sampling phase error. Of course, the performance sample for t2 may occur before t2, such as during the interval between t1 and t2. However, the series of performance sample intervals tested against the master sample interval is increased by one sample each time. If the performance sample for t2 does occur before t2 for any particular comparison between the performance and master sampling interval, the performance sample for t2 will eventually occur at t2, or between t2 and t3, during a subsequent comparison.

Because the performance samples are compared against master sample windows, 32 samples in a master sample interval provides only 31 sample windows. Therefore only 31 comparisons are made. A first performance sample to be compared against the master sampling interval may be the 31 samples beginning at the beginning of an actual second and therefore extending 31/200ths of a second thereafter. If a positive match between the shape of the performance sample and master sample is not made, the next performance interval to be compared against the sample interval would be the 31 samples beginning at one 200th of a second after the beginning of the second and extending 31/200ths of a second thereafter to 32/200ths of a second after the beginning of the second. The performance sampling interval is therefore advanced by one 200th of a second until the sum of the squares of the errors is below the predetermined threshold indicating a pattern match at which time a timing mark is generated.

There are many ways to implement the windowing sample comparison technique of the present invention. The presently preferred implementation uses the centerpoint, or average amplitude value, and the permitted or window error within each window from the centerpoint, to determine the value to be used for each error factor. The center point, Cp, for any particular window is one half the absolute value of the sum of the amplitudes of the samples at the window edges and may be determined as follows:

$$Cp=|ms_tn+ms_tn+1|/2. \quad (5)$$

The window error, We, is then the absolute value of the difference between centerpoint and either sample, i.e.

$$We=|Cp-ms_tn|. \quad (6)$$

The performance sample is within the master sample window if the difference between the performance sample amplitude and the center point is less than the window error. This condition results in the use of a zero value for the sample error, e_tn, for that sample. If the performance sample is not within the window, the difference between the performance sample amplitude and the center point is greater than the window error. The amount by which this difference exceeds the window error, when squared, is then used as the sample error; as follows:

$$\begin{aligned} &\text{If } |ps_tn - Cp| \leqq We, \\ &\text{then } e_tn = 0. \\ &\text{Else } e_tn = (|ps_tn - Cp| - We)^2. \end{aligned} \quad (7)$$

The sample error for each sample in a performance interval may then be determined for each such master sample interval window. The sum of such performance errors represents the magnitude of the curve fitting error. If this magnitude is not below a predetermined limit which represents an acceptable match, the samples within the performance sample are increased by one dropping off the first sample and adding one at the end of the interval, and the calculation is then repeated until an acceptable match is achieved. A suitable timing mark may then be generated to synchronize the operation of keyboard/strummer 10 with the rendition of pre-recorded performance 18 being played from unmodified media such as a CD.

The accuracy of typical playing devices, such as CD player 55*a*, is extremely high so that after the timing mark provides the initial synchronizing event, the accuracy of the counting by counter 282 should be sufficient to maintain synchronization between the mapping data and the performance for the duration of pre-recorded performance 18.

Figure 26:
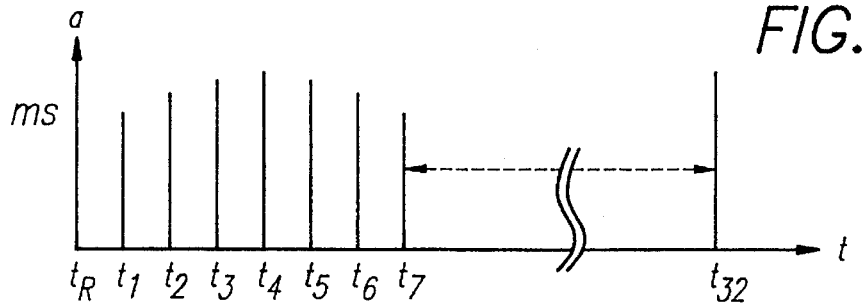
FIG. 26 is a graphical illustration of an audio waveform of a master sampling interval used in the synchronization technique described with regard to FIG. 24.
Figure 27:
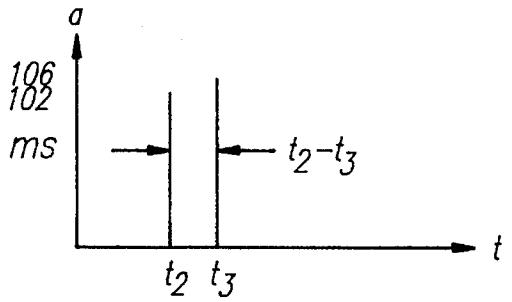
FIG. 27 is an enlarged view of two samples of the master performance shown in FIG. 26 which together form a sampling window.

Referring now to FIG. 26, the series of 32 master samples taken at times t1 through tn and stored in ROM pack 24 are shown. Each pair of master samples are considered as a window and compared to the appropriate performance sample to determine a pattern match. One such window, the master sample window extending from t2 through t3, is shown in FIG. 27.

As noted above, the relative timing of the sampling between these samples in the master sampling interval, and the samples taken in the performance sampling interval shown for example in FIG. 24, is unknown and to be determined. The performance samples are continuously taken at the same rate, such as 200 samples per second, until the analysis indicates an acceptable pattern or shape match. Each set of 32 performance samples is individually tested against the same master sample interval until a match is found. Each such set of performance samples is determined by dropping off one sample at the beginning and adding a sample at the end.

Figure 28:
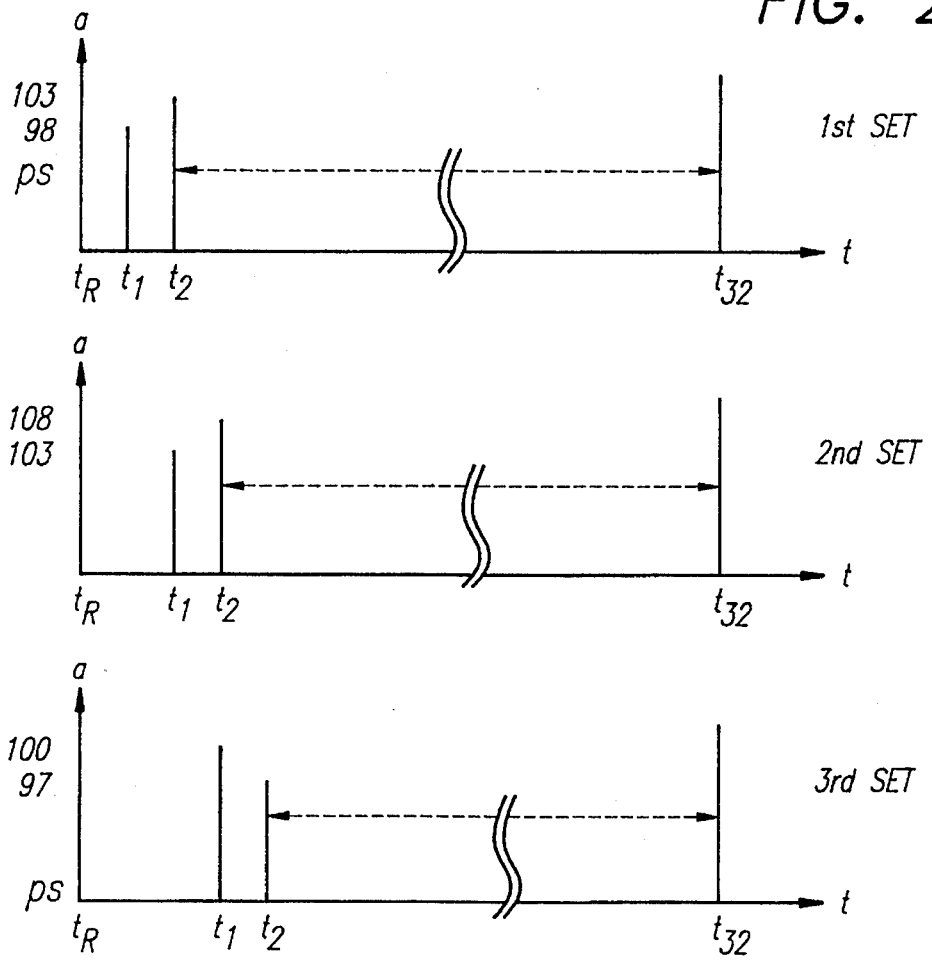
FIG. 28 is a series of three graphs using the same time scale indicating the sequences of samples used in three sequential sets of performance sampling intervals used for comparison with the master sampling interval illustrated in FIG. 26.

For example, the 1st set shown in FIG. 28 of performance samples t1 through t32 is shown to begin one sample, or 1/200th of a second, after reference time tR. Performance sample t2 which will be compared against master sample window t2–t3 occurs at 2/200ths of a second after tR in the 1st set. If this performance sample does not achieve an acceptable match, 32 samples beginning at 2/200th of a second after tR are used as the 2nd set of performance samples to be tested. If this performance sample does not achieve an acceptable match, 32 samples beginning at 3/200th of a second after tR are used as the 3rd set of performance samples to be tested, as shown.

For clarity, an example of the determinations made for e t_t2 for each of the three sets will now be provided for ms t2=102 and ms_t3=106.

$$Cp=|102+106|/2=104,\ We=|102-104|=2. \quad (8)$$

In the 1st set, t2=103, so e_t2 is set to 0 because ps_t2 is within the master sample window. Similar calculations are performed for each such window and if the sum of the squares of the errors is within acceptable limits, a pattern match is declared and the timing mark is generated.

If not, the second set of performance samples is tested. In the 2nd set, t2=108 which is not within the window of amplitudes from 102 to 106, so e_t2 is determined by:

$$e_t2=(|104-108|-2)^2=(2)^2=4. \quad (9)$$

Similarly, if the sum of the squares of the errors does not indicate a pattern match for the 2nd set, another iteration is performed using the 3rd set in which t2=97, as follows:

$$e_t2=(|104-97|-2)^2=(7)^2 49. \quad (10)$$

These iterations continue for as many sets of performance samples as are necessary until a suitable match is determined and synchronization is accomplished.

There are many other modifications and changes to the methods and systems presented herein for providing note assisted musical performances which are within the skill of a person having ordinary skill in this art and which would not depart from the spirit or scope of the present invention which is determined by the scope of the followings claims.

I claim:

1. An electronic musical instrument, comprising:

memory means for storing data related to pre-recorded music;

Sampling means for deriving samples from a performance of the pre-recorded music;

comparison means for comparing said samples to a portion of said data to synchronize said data with said performance; and means responsive to said data and to playing by a musician during said performance to produce music related to the pre-recorded music.

2. The invention of claim 1 wherein, the sampling means further comprises:

averaging means for deriving an average value of said samples; and normalization means for normalizing each sample in accordance with said average value.

3. The invention of claim 2, wherein said comparison means operates upon a subset of said samples and further comprises:

means for deriving a plurality of subsets of said samples by removing a fixed number of samples from the beginning of first subset and adding said fixed number of samples after the end of said first subset.

4. The invention of claim 1, wherein the comparison means further comprises:

least squares means for deriving the sum of the squares of the differences between portion of the data and the amplitude of each of the samples of each of the plurality of subsets of samples to determine the subset of samples having a predetermined correlation to the data.

5. A method for assisting a musician to produce music related to pre-recorded music, comprising the steps of:

providing a performance of the pre-recorded music to the musician;

comparing at least a first and a second subset of samples of the performance to samples of the pre-recorded music to determine a correlation therebetween;

providing data related to the pre-recorded music, said providing being synchronized with the performance in response to said comparing; and producing music in response to actions of the musician in accordance with the data being provided at the time of said actions.

6. The invention of claim 5, wherein the step of comparing further comprises the steps of:

deriving an average value of the first subset of said samples; and normalizing each sample in said first subset of samples in accordance with said average value.

7. The invention of claim 6, wherein the step of sampling further comprises the steps of:

deriving the second subset of samples by removing a fixed number of samples from the beginning of said first subset and adding said fixed number of samples after the end of said first subset.

8. The invention of claim 5, wherein the step of comparing further comprises the step of:

deriving the sum of the squares of the differences between selected amplitudes in the data and the amplitudes of each of the samples of each of the plurality of subsets of samples.

9. A method for assisting a musician to produce a musical rendition related to pre-recorded music, comprising the steps of:

recording one or more tracks of note assist data synchronized to a studio performance of the pre-recorded music, each track of note assist data representing a musical component of the original music;

deriving a master sampling interval of samples of a beginning portion of the pre-recorded music;

deriving performance samples of a beginning portion of a session performance of the pre-recorded music;

forming a series of sequential performance sampling intervals from subsets of the performance samples;

comparing each performance sampling interval to the master sampling interval to determine the correlation therebetween;

synchronizing the note assist data with the session performance in accordance with the correlation;

producing key signals in response to musical instrument actuation by the musician during the session performance of the pre-recorded music; and producing a rendition related to the pre-recorded music in response to the key signals modified by the note assist data provided at the time of the actuation that produced each such key signal.

10. The invention of claim 9, further comprising the steps of:

dividing the amplitudes of the samples in the master sampling interval by a factor related to an average of the amplitudes of the samples in the master sampling interval; and dividing the amplitudes of the samples in each performance sampling interval by a factor related to an average of the amplitudes of the samples in each such performance sampling interval.

11. The invention of claim 10, wherein the step of comparing further comprises:

comparing each performance sample of a first one of the series of performance sampling intervals to a corresponding and subsequent master sample in the master sampling interval to determine if the amplitude of said performance sample is between the amplitudes of said corresponding and subsequent master samples; and determining the sum of the squares of the differences in amplitude between each performance sample not between the amplitudes of said corresponding and subsequent master samples, and the nearest amplitude for each such performance sampling interval which is between the amplitudes of said corresponding and subsequent master samples until said sum is sufficiently low to indicate a match between said performance sampling interval and said master sampling interval.

* * * * *